US007998052B2

(12) United States Patent
Chammas

(10) Patent No.: US 7,998,052 B2
(45) Date of Patent: Aug. 16, 2011

(54) ROTOR DEFINING A FLUID SEPARATION CHAMBER OF VARYING VOLUME

(76) Inventor: Jacques Chammas, Walpole, MA (US)

( * ) Notice: Subject to any disclaimer, the term of this patent is extended or adjusted under 35 U.S.C. 154(b) by 1346 days.

(21) Appl. No.: 11/368,502

(22) Filed: Mar. 7, 2006

(65) Prior Publication Data

US 2007/0213191 A1 Sep. 13, 2007

(51) Int. Cl.
*B04B 1/02* (2006.01)

(52) U.S. Cl. ..... 494/48; 494/26; 494/41; 494/45; 494/67

(58) Field of Classification Search ..... 494/18, 494/23–30, 38, 41, 43, 45, 47–48, 50, 56; 210/781–782
See application file for complete search history.

(56) References Cited

U.S. PATENT DOCUMENTS

| | | | | |
|---|---|---|---|---|
| 2,661,150 | A | 12/1953 | Abbott, Jr. | |
| 3,096,283 | A * | 7/1963 | Hein | 494/38 |
| 3,104,225 | A * | 9/1963 | Di Benedetto | 494/45 |
| 3,239,136 | A * | 3/1966 | Hein | 494/1 |
| 3,244,362 | A * | 4/1966 | Hein | 494/1 |
| 3,244,363 | A * | 4/1966 | Hein | 494/1 |
| 3,297,244 | A * | 1/1967 | Hein | 494/10 |
| 3,456,875 | A * | 7/1969 | Hein | 494/3 |
| 3,489,145 | A | 1/1970 | Judson et al. | |
| 3,565,330 | A | 2/1971 | Latham, Jr. | |
| 3,581,981 | A | 6/1971 | Latham, Jr. | |
| 3,675,846 | A * | 7/1972 | Drucker | 494/45 |
| 3,706,412 | A | 12/1972 | Latham, Jr. | |
| 3,737,096 | A | 6/1973 | Jones et al. | |
| 3,987,961 | A | 10/1976 | Sinn et al. | |
| 4,007,871 | A | 2/1977 | Jones et al. | |
| 4,010,894 | A | 3/1977 | Kellogg et al. | |
| 4,056,224 | A | 11/1977 | Lolachi | |
| 4,086,924 | A | 5/1978 | Latham, Jr. | |
| 4,151,844 | A | 5/1979 | Cullis et al. | |
| 4,227,814 | A | 10/1980 | Soodak et al. | |
| 4,285,464 | A | 8/1981 | Latham, Jr. | |
| 4,300,717 | A | 11/1981 | Latham, Jr. | |
| 4,303,193 | A | 12/1981 | Latham, Jr. | |
| 4,447,221 | A | 5/1984 | Mulzet | |
| 4,530,691 | A | 7/1985 | Brown | |
| 4,680,025 | A | 7/1987 | Kruger et al. | |
| 4,806,252 | A | 2/1989 | Brown et al. | |
| 4,889,524 | A | 12/1989 | Fell et al. | |
| 4,911,833 | A | 3/1990 | Schoendorfer et al. | |
| 4,934,995 | A | 6/1990 | Cullis | |
| 4,940,543 | A | 7/1990 | Brown et al. | |
| 4,943,273 | A * | 7/1990 | Pages | 494/41 |
| 4,983,158 | A * | 1/1991 | Headley | 494/41 |
| 5,045,048 | A | 9/1991 | Kaleskas et al. | |
| 5,100,372 | A * | 3/1992 | Headley | 494/41 |
| 5,114,396 | A | 5/1992 | Unger et al. | |
| 5,141,486 | A | 8/1992 | Antwiler | |
| 5,217,427 | A | 6/1993 | Cullis | |
| 5,316,540 | A | 5/1994 | McMannis et al. | |
| 5,368,542 | A | 11/1994 | McMannis et al. | |
| 5,387,174 | A | 2/1995 | Rochat | |

(Continued)

*Primary Examiner* — Charles E Cooley
(74) *Attorney, Agent, or Firm* — Rissman Hendricks & Oliverio, LLP

(57) ABSTRACT

A rotor having variable volumes adapted for collecting and centrifuging biological fluids including an impermeable flexible body having a cylindrical shape with stretchable vertical walls and semi pliant base and a rigid circular member seamlessly joined to the top of the flexible body.

10 Claims, 17 Drawing Sheets

U.S. PATENT DOCUMENTS

| | | | | |
|---|---|---|---|---|
| 5,387,187 | A | 2/1995 | Fell et al. | |
| 5,651,766 | A | 7/1997 | Kingsley et al. | |
| 5,658,231 | A | 8/1997 | Schmitt et al. | |
| 5,728,040 | A | 3/1998 | Schill et al. | |
| 5,728,060 | A | 3/1998 | Kingsley et al. | |
| 5,733,253 | A | 3/1998 | Headley et al. | |
| 5,779,660 | A | 7/1998 | Kingsley et al. | |
| 6,074,335 | A | 6/2000 | Headley et al. | |
| 6,123,655 | A | 9/2000 | Fell | |
| 6,602,179 | B1 * | 8/2003 | Headley et al. | 494/41 |
| 6,733,433 | B1 | 5/2004 | Fell | |
| 6,852,074 | B1 | 2/2005 | Jorgenson et al. | |
| 7,425,192 | B2 * | 9/2008 | Sacco et al. | 494/27 |
| 7,452,322 | B2 * | 11/2008 | Headley et al. | 494/41 |
| 2007/0213191 | A1 * | 9/2007 | Chammas | 494/41 |

* cited by examiner

ROTOR DEFINING A FLUID SEPARATION CHAMBER OF VARYING VOLUME

FIELD OF THE INVENTION

This invention generally relates to systems for processing blood and other biological fluids.

BACKGROUND OF THE INVENTION

Transfusion therapy in the past was largely dependent on the use of whole blood. While whole blood may still be used in certain limited circumstances, the modern transfusion therapy depends largely on the use of the clinically needed blood component. Whole blood consists of many components, primarily, red blood cells, white blood cells, platelets, and plasma. Therefore, there was the need for specialized equipment capable of processing drawn blood from a donor to extract the needed component and return the rest back to the donor. These equipment, known as Apheresis equipment, are largely dependent on centrifugation processes to separate blood components. These centrifugation processes are divided in two categories, continuous flow process, and batch process.

Systems utilizing continuous flow process direct the flow of the whole blood drawn from a donor through one channel into a spinning centrifuge rotor where the components are separated. The needed component is collected and the unwanted components are returned to the donor through a second channel on a continuous basis as more whole blood is being drawn. The continuous flow has the advantage of having a low extracorporeal volume, since the blood is processed as it flows continuously from the donor through the system and back to the donor. The amount of blood that is out of the donor at any time during the procedure is relatively small. The disadvantage with this system is that although the processing chamber where the blood is separated has a small volume, it has a relatively large diameter and more often it has a large tube rotating around it at a larger radius. Consequently, the continuous systems are large and are complicated to set up and use. A major disadvantage to most continuous systems is that two separate channels are used simultaneously to drive blood from the donor and to return unwanted components back to the donor. In most applications the donor is punctured with two intravenous needles to secure the channels. These devices are used almost exclusively for the collection of platelets in blood bank environment. These devices are not used for blood washing and salvaging in the operating room (OR) environment, due to the large size and noise level.

Systems utilizing batch process draw whole blood from a donor and direct it through a channel to fill a spinning rotor with a constant volume. This type of rotors is intentionally built with relatively large volume to process a substantially large amount of blood at each batch cycle. When the rotor is full, the drawing of the blood from the donor is stopped. The unwanted components of the separated blood are returned to the donor through the same channel that used to draw blood. After returning unwanted components and the rotor is emptied, blood is drawn from the donor to start the second batch cycle. This process is repeated until the desired blood volume is processed or the desired component volume is collected. Systems with batch process are relatively small and more compact in size. The size of the rotor is very critical for the batch process. Large rotors speed up the process but require large extracorporeal volume. Small rotors slow down the process and require many batch cycles to collect one unit of needed component.

There have been many attempts to develop a batch process rotor with adjustable volume to accommodate for the variation of the processed batches of blood. The invention documented in U.S. Pat. Nos. 5,733,253, 6,074,335, and 6,099,491 describes a compact rotor comprising a rigid member and a flexible diaphragm. The diaphragm is stretched by vacuum to fill the rotor with blood then compressed by pressurized air to express the separated components. The fine thickness of the membrane and the inconsistency in stretching geometry mixed with the induced stresses generated by the centrifugal forces can cause the diaphragm to rupture catastrophically spilling out all the blood.

The whole body of the rotor in U.S. Pat. No. 3,737,096 is made of flexible PVC film. The volume of this rotor can vary to control the hematocrit of the final product. But the shape and the big size of the rotor necessitate the system to be large and awkward to handle.

There exists the need, therefore, for a centrifugal system for processing blood and other biological fluids that is compact, easy to use, and has a durable rotor capable of adjusting its volume.

BRIEF DESCRIPTION OF THE INVENTION

The present invention provides a container, referred to herein as a rotor, which may be used for collecting and centrifuging biological fluids in a range of volumes. The rotor includes an impermeable flexible body having a cylindrical cup shape with stretchable vertical walls and less pliant base. The rotor includes a rigid circular member that is seamlessly joined to the flexible cup opening. The circular rigid member and the flexible cup define the chamber in which the fluid is centrifuged.

In a preferred embodiment, the rigid circular member, referred to herein as the "Cover" defines the top of the processing chamber. The flexible cup, referred to herein as the "Body", is attached to the perimeter of the rigid cover and defines the remainder of the processing chamber.

In a preferred embodiment, the rigid cover defines one opening, preferably near the axis of rotation at the top of the processing chamber, permitting a conduit or conduits to pass therethrough so as to be in fluid communication with the processing chamber. In another alternative embodiment, the cover has a plurality of openings for controlling the flow into and/or out of the rotor while the rotor is being spun.

In a preferred embodiment, the cover may include a separate arrangement for controlling the flow of liquid out of the chamber into the rotor's (outlet) conduit. Preferably this arrangement is structured as an elevated chamber extend from and congruent to the separation chamber. This elevated chamber, referred to herein as the "Atrium" houses flared out conduit end that directs the fluid flow to exit the rotor.

In another preferred embodiment, the fluid communication means between the rotating processing chamber and the stationary environment may include two or more non-rotating conduits. This embodiment permits unseparated fluid to flow into the spinning rotor through one conduit, while separated fluid can flow out of the rotor through the other conduit. These conduits may be situated in a concentric arrangement and may further be encircled by a stationary wall, so as to provide a channel permitting fluid to flow from the rotor's conduit to the chamber's periphery or backward. Furthermore these non-rotating conduits are considered fixed portion of the rotor.

In another preferred embodiment, the rotor includes a cylindrical shaped body forming a vertical barrier defining the radially inner wall of the separation chamber. The body referred to herein as a "Core" is essential in stabilizing the rotating fluids inside the separation chamber, more importantly in the vicinity of the exiting port. The core defines a partition having communication channels between the atrium and the separation chamber to direct and streamline the exiting fluid flow. Preferably the core has a rigid structure to withstand the centrifugal forces.

In another preferred embodiment, the rotor includes a circular plate that is adjacent to the flexible base of the rotor to divert the fluid entering the rotor to the periphery of the processing chamber. The circular plate, referred to herein as the "Diverter" defines an opening, preferably near the axis of rotation, permitting the inlet conduit to pass there through or to discharge the fluid at the bottom center of the rotor.

Alternative embodiments of the rotor do not have a fixed portion. The conduits extending from these embodiments of the rotor thus spin with the rest of the rotor during centrifugation. A rotary seal may be located at some point in the tubing connecting the rotor with the rest of the processing set. Alternatively, a skip-rope system may be used in lieu of a rotary seal.

The embodiments of the rotor having a fixed portion preferably include a rotary seal to maintain a closed system between the stationary portion and the rotating assembly of the rotor. Such a rotary seal has first and second seal faces, which spin in relation to each other, and a resilient seal member. The resilient seal is mounted on the stationary conduit assembly, and the first seal face is attached to the resilient seal member so that the resilient seal presses the first seal face against the second seal face that is mounted on the rotating cover. Preferably, the resiliency of the seal member is enough to apply adequate contact force between the first and the second seal faces. Such contact force is not adversely affected by pressure within the rotor. Alternatively, if the resilient seal member is not strong enough to apply the proper force between the first and second seal faces, a separate spring member may be necessary to achieve the required contact force.

In a preferred embodiment the rotor is mounted to a centrifuge bucket and spun therewith. The spinning bucket has a cylindrical shape fitted to accept the flexible body. The bucket having a rigid base plate, referred to herein as the "Chuck", is permitted to slide vertically up and down along the sidewall inside the bucket while the centrifuge is spinning.

In a preferred embodiment a circular overhang at the perimeter of the cover of the rotor allows it to engage with the top edge of the bucket sidewall. When the rotor is inserted in the centrifuge bucket, the rigid cover is attached to the top edge of the bucket wall covering to the bucket opening. The flexible body of the rotor is contained inside the bucket with the flexible base of the processing chamber deposed on the chuck. Preferably, the flexible rotor base is firmly secured to the chuck by vacuum means. It is the objective of the invention that the flexible base of the rotor moves vertically in conjunction with the chuck. As the top rigid boundary of the processing chamber remains fixated at the top edge of the bucket wall, the volume of the processing chamber increases as the chuck moves downward pulling the flexible base therewith. The stretchable sidewall of the processing chamber that is juxtaposed to the bucket sidewall expands by the same magnitude as the base is pulled down and retracts by the same magnitude as the base is pushed up until it reaches its original setting. As the chuck moves down the capacity of the processing chamber is amplified. By contrast, as the chuck moves up, the capacity of the processing chamber diminishes until it reaches the original setting. Therefore, the vertical position of the chuck determines the capacity of the processing chamber. The solid wall of the bucket radially supports the stretched wall of the processing chamber preventing any deformation to the rotor caused by the centrifugal force. The capacity or the volume of the processing chamber is linearly related to the height of the chamber. A rotor at initial stage having a height "h" and a volume "v" will have a volume of "2v" when its height is stretched to "2h". This allows the collected product to have the required concentration. For example the hematocrit of collected red cell unit can be controlled in case of blood processing.

In a preferred embodiment a distance measuring device situated at a fixed and referenced location with respect to the chuck. The device works on the concept of emitting signals directed to the chuck. The reflecting signals from the chuck determine the distance between the device and the chuck knowing the time interval between emitting and receiving the signal. The signal can be but not limited to ultrasound, laser, or optic. Preferably the device is located underneath the bucket and sends signals through a window placed at the bucket base. The signal targets the bottom surface of the chuck and reflects back to the device. The device has a fine resolution enough to determine the position of the chuck at any time and defines the traveled distance as the chuck moves vertically. The traveled distance of the chuck is the same magnitude as the stretching distance of the rotor's flexible wall. Therefore, the system can define the position of the chuck and the capacity of the processing chamber at any time.

In a preferred embodiment, a biological fluid is introduced inside a spinning rotor though an inlet conduit. The chuck holding the base of the rotor moves slowly downward increasing the capacity of the processing chamber while it is being filled. A biological fluid having components of different densities are separated in discrete layers inside the processing chamber. Components having the highest density are sedimented at the outmost periphery and components of lowest density are positioned the closest to the axis of rotation. When the processing chamber reaches its maximum capacity, the vertical travel of the chuck stops. The flow of the biological fluid into the processing chamber continues as the component of the least density exit the chamber and the highest density are concentrated at the periphery of the processing chamber. The flow of the biological fluid stops as the separation line between the discrete layers reaches a certain distance from the axis of rotation or the whole volume of the biological fluid is introduced in the processing chamber. The chuck starts to move slowly in the upward direction gradually diminishing the capacity of the processing chamber. The component of the least density that is positioned in the vicinity of the axis of rotation and therefore the closest to the outlet conduit is forced to exit the processing chamber. When the least density layer is pushed out, the chuck starts to move slowly downward increasing the capacity of the processing chamber allowing for more biological fluid to enter the processing chamber until the latter reaches maximum capacity. This process is repeated until the chamber is filled with high density component.

In a preferred embodiment the vertically traveling chuck is mounted on a spring-loaded piston that is embedded in the rotating centrifuge. The piston controllably moves up and down along the vertical axis that coincides with the rotating axis while the centrifuge is spinning. The piston moves down as the compressed fluid pressure increases, and moves up as the pressure decreases. Preferably, the compressed fluid is air. The compressed air is fed to the piston from an outside compressor disposed in the stationary portion of the system. The compressed air is furnished to the spinning assembly through a rotating seal at the bottom end of the shaft, and supplied to the piston through a passageway along the axle.

In another preferred embodiment the rotor has an inner core that extrudes from the partition starting at the opening and extends downward to the bottom of the core then flanges out radially and connects to the bottom of the core wall just above the drain openings. The inner core forms a chimney-stack surrounding incoming fluid tubing preventing any fluid from being trapped inside the core. The rotor also has a splash barrier that forms a circular wall surrounding the central opening on the diverter acting as a funnel for the incoming fluid.

In another preferred embodiment, the chuck is mounted on a rotating linear screw rod powered by an electrical or pneumatic motor embedded in the rotating centrifuge. The rod, the chuck, and the centrifuge shaft have identical axis of rotation. The rod travels vertically up and down along the axis of rotation inside a cylindrical shaped cavity located within the shaft. The chuck and the rod are connected in a way that the rod rotates freely with respect to the chuck and both parts move collectively in the vertical direction. As the rod turns in one direction, the chuck travels vertically downward pulling down the flexible base of the rotor. As the rod turns in the other direction, the chuck travels upward returning the base to the original setting. The electric motor is energized by an outside power supply disposed in the stationary portion of the system. The electric current is transmitted to the spinning assembly through rotating slip rings mounted on the centrifuge shaft.

In another preferred embodiment, the chuck is fixated to the rotating shaft while the bucket moves vertically up and down relative to the chuck. In this embodiment, the bucket is attached to an embedded piston rod, or attached to an embedded motor screw that controllably move the bucket. A rotor mounted on this centrifuge embodiment, by having its base secured by the fixed chuck and its cover captured by a moving bucket. The volume of the spinning rotor can vary by stretching or retracting the stretchable wall by the controlled movement of the bucket. Biological fluid processing operations for this embodiment are identical to the operations of the embodiments explained above The centrifuge system is preferably integrated with other systems, subsystems, modules, and components in order to realize a blood processing system. The rotor is preferably integrated with a sterile disposable set arrangement to be used with the blood processing system.

The blood processing system may also include in the addition to the centrifuge system but not restricted to, pumps preferably peristaltic pumps, optic sensors, pressure sensors, ultrasonic sensors, load sensors, proximity sensors, fluid sensors, scales, valves, pneumatic system, vacuum system, air compressors, power supplies, and a programmable control system with data storage and input output means controlling all the above mentioned systems, subsystems, modules and components.

The rotor and centrifuge systems of the present invention may be used in many different processes involving biological fluid. A method for using the rotor would generally include the steps of introducing an unseparated fluid into the rotor's processing chamber while expanding rotor capacity by pulling the base down and vertically stretching the sidewall, spinning the rotor so as to separate the fluid into denser and lighter components, and squeezing the separation chamber by displacing the chuck vertically upward and relieving the stretched sidewall so as to force out a fluid component—usually the lighter fluid components—through the conduit.

Further aspects of the present invention will be apparent from the following description of specific embodiments, the attached drawings and the appended claims.

BRIEF DESCRIPTION OF THE DRAWINGS

The foregoing and other objects, features and advantages of the invention will be apparent from the following more particular description of preferred embodiments of the drawings in which like reference characters refer to the same parts throughout the different views. The drawings are not necessarily to scale, emphasis instead being placed upon illustrating the principles of the invention.

DETAILED DESCRIPTION OF THE INVENTION

Figure 1:
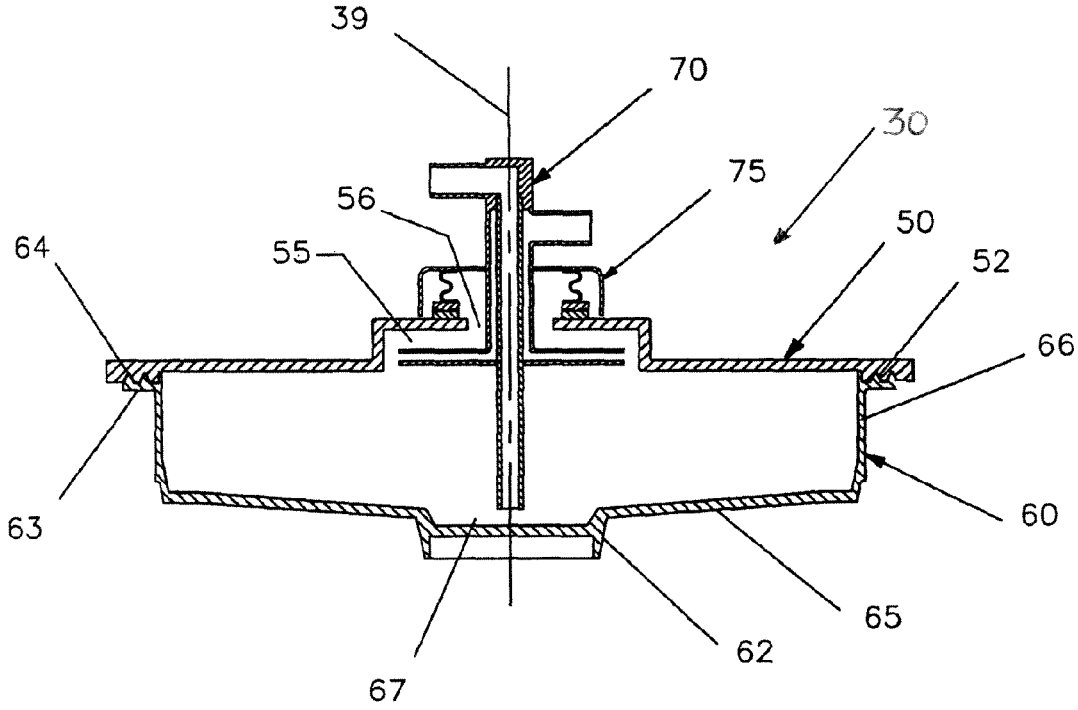
FIG. 1—A cross sectional view of one version of the centrifuge rotor

FIG. 1 shows a cross sectional view of one version of the centrifuge rotor 30 according to the present invention. The rotor 30 has an elastic body 60, which is sealed to a rigid cover 50 by bonding, welding, or other means. The rigid cover is preferably made of clear and hard plastic material such as polycarbonate. The cover typically has the shape of a circular disc with a vertical extrusion at the center forming a small cylindrical chamber 55 referred to herein after as atrium. The top section of the atrium defines a circular opening 56 at the center. The cover, the atrium and the opening are concentric and have identical axis of rotation 39.

The elastic body is preferably made of a resilient and stretchable material, such as silicone rubber. The body has stretchable vertical wall 66 connecting the base 65 to the rim 63. The rim surface has a serration 64 that is used to seamlessly join the rim to a matching geometry 52 on the periphery of the cover generating a robust bonding that resists the effects of the centrifugal forces. The integrated assembly of the cover and the body form impermeable chamber for spinning fluid at high speed. This chamber is referred to herein after as the processing chamber. The inner surface of the base has a gentle radial slope toward the center to drain fluid into a circular depression 67. The outside geometry of the depression forms a tapered extrusion 62 utilized to position the base inside the centrifuge system. The rotor 30 has a fluid channeling assembly 70, which is attached to a sterile plastic disposable set (not shown), and a rotary seal assembly 75. The fluid channeling assembly is stationary and does not spin with the rotor. A special arm (not shown) extends from the static section of the system to hold the fluid channeling assembly in place.

Figure 2:
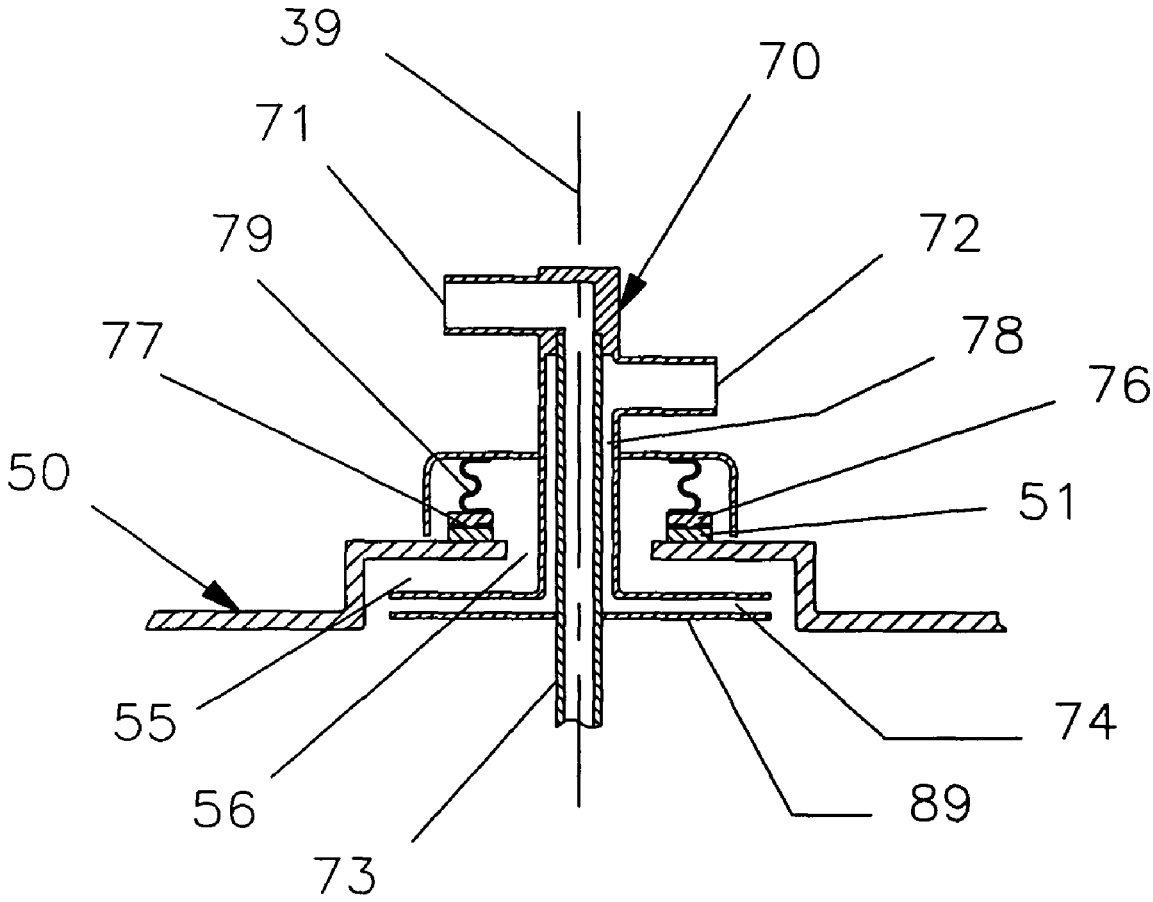
FIG. 2—A cross sectional view of the fluid channeling assembly and the rotary seal FIG. 3—A cross sectional view of one version of the centrifuge rotor having a core and a diverter FIG. 4—A cross sectional view of the chuck and a piston assembly of the centrifuge system FIG. 5—A cross sectional view of a rotor mounted on a centrifuge system at initial setting FIG. 6—A cross sectional view of a stretched rotor mounted on a centrifuge system at maximum capacity FIG. 7—A cross sectional view of a centrifugal clutching mechanism between the base of the rotor and the chuck FIG. 8—A cross sectional view of a centrifuge system encompassing a linear motor FIG. 9—A view of a wireless signal transmitting system positioned at the bottom of the axel FIG. 10—A cross sectional view of a stretched rotor mounted on a centrifuge system encompassing a linear motor FIG. 11—A view of RBC and PRP separation inside a rotor FIG. 12—A view of RBC, Buffy Coat, and Plasma separation inside a rotor FIG. 13—A schematic drawing of apheresis system FIG. 14—A schematic drawing of the blood salvaging system FIG. 15—A cross sectional view of rotor at initial setting mounted on a centrifuge system encompassing a piston with movable bucket FIG. 16—A cross sectional view of a stretched rotor mounted on a centrifuge system encompassing a piston with movable bucket FIG. 17—A cross sectional view of a stretched rotor mounted on a centrifuge system encompassing a linear motor with movable bucket

In the present embodiment, referring to FIG. 2, the fluid channeling assembly has an inlet port and an outlet port. The inlet port 71 is attached to the feed tubing 73 extending inside the rotor through the opening 56 and along the axis of rotation 39. The outlet port 72 is attached to an annulus channel 78 that surrounds tubing 73 and connected to a flared out effluent channel 74 that is sandwiched between two circular plates, referred to herein as effluent discs 89. The effluent discs are disposed inside the atrium chamber 55 and extend radially outward short of the atrium edge wall.

The rotary seal permits the rotor to spin at high rotational speed while the fluid channeling assembly is held stationary without compromising the closed and sterile environment inside the rotor 30. The rotary seal is realized at the interface of two rings rotating with respect to each other. Both rings are completely flat and are made of hard material having very smooth surface and can endure high temperature. Such materials can preferably be ceramic or heat resistant plastic like PEEK. In this embodiment, the first ring 51 is attached to the top of the atrium chamber and spins with the rotor. The inner diameter of the ring is large enough to clear for the opening 56 with which it is concentric. The second ring 76 is floating on the top of the first ring and has the inner diameter large enough to clear for the opening 56. A resilient seal 79 that is attached to the stationary fluid channeling assembly holds this ring and presses it against the spinning first ring. Preferably the second ring has a circular projection 77 that contacts the first ring to minimize the friction and the heat generated between the two rings. The resilient seal 79 is affixed to the fluid channeling assembly on one end and it is attached to the second ring 76 on the other end maintaining a closed system environment. Preferably, the resiliency of the seal member 79 is enough to apply adequate contact force between the first and the second seal faces. Such contact force is not adversely affected by pressure within the rotor. Therefore, the two seal surfaces are kept in closed contact preserving the sterile integrity of the rotor.

Figure 3:
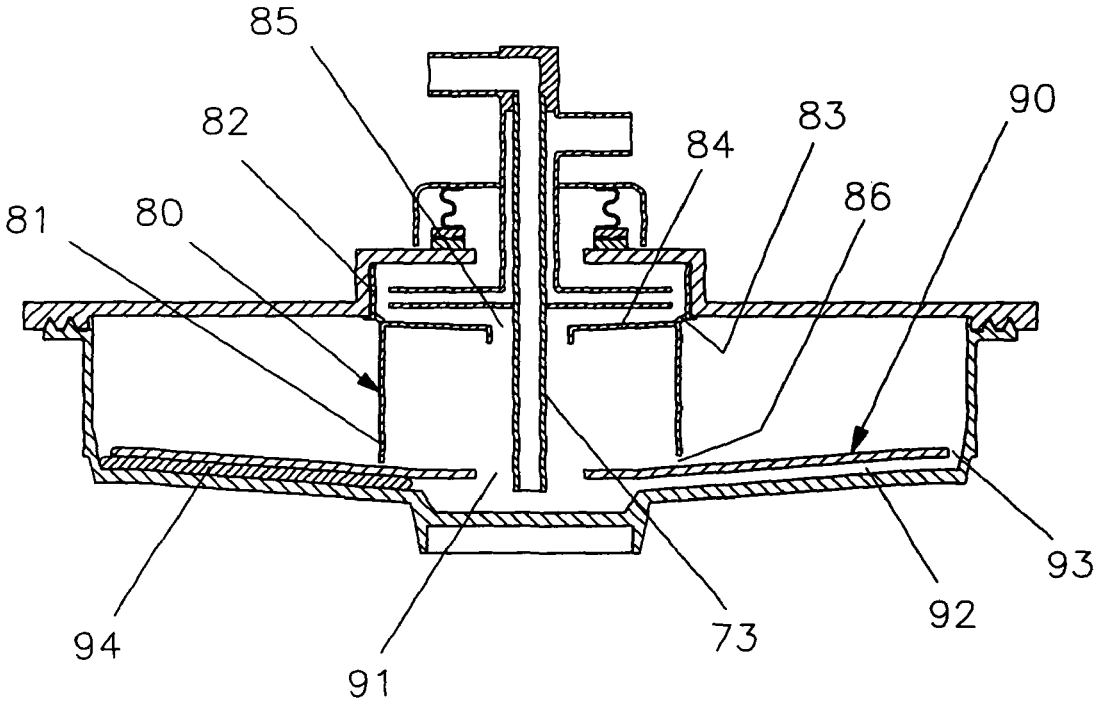

Another version of the rotor is shown in FIG. 3. The rotor in this embodiment has a core 80 to stabilize the rotating fluids inside the separation chamber and to stream line the exiting fluid flow. The core is cylindrical in shape and it is divided in two sections separated by a partition 84 that identifies the boundary between the atrium and the processing chamber. This partition defines a circular opening 85 at the center permitting tubing 73 to pass through. Opening 85 is wide enough to allow the core to spin with the rotor while tubing 73 is stationary. The upper section of the core has a wall 82 that is tightly fitted to the atrium sidewall. Therefore, the core is securely attached to the rotor cover. Small openings 83 are positioned at the bottom of wall 82 and above the partition 84 permitting for a fluid communication between the separation chamber and the atrium chamber. These openings are utilized by the exiting fluid to reach the effluent discs on the fluid channeling assembly.

The lower section of the core hangs freely inside the rotor and has a wall 81 defining the radially inner wall of the separation chamber. Small openings 86 are situated in the lower end of the core to allow for the fluid to drain down to the bottom of the rotor when it is stopped from rotating.

FIG. 3 depicts a diverter 90 placed in the vicinity of the rotor base to divert the incoming fluid to the periphery of the processing chamber. The diverter has the shape of a circular plate defining an opening 91 at the center. This opening is large enough to allow for tubing 73 to pass through. The diverter 90 is confined at a small distance from the base by equally spaced standing ribs 94, thereby forming a passage 92 for the incoming fluid. The ribs extend for a short distance beyond the outside diameter of the diverter to embrace it in a concentric position with respect to the rotor. Therefore, a channel 93 is formed at the periphery of the rotor acting as an entrance way to the processing chamber.

Figure 4:
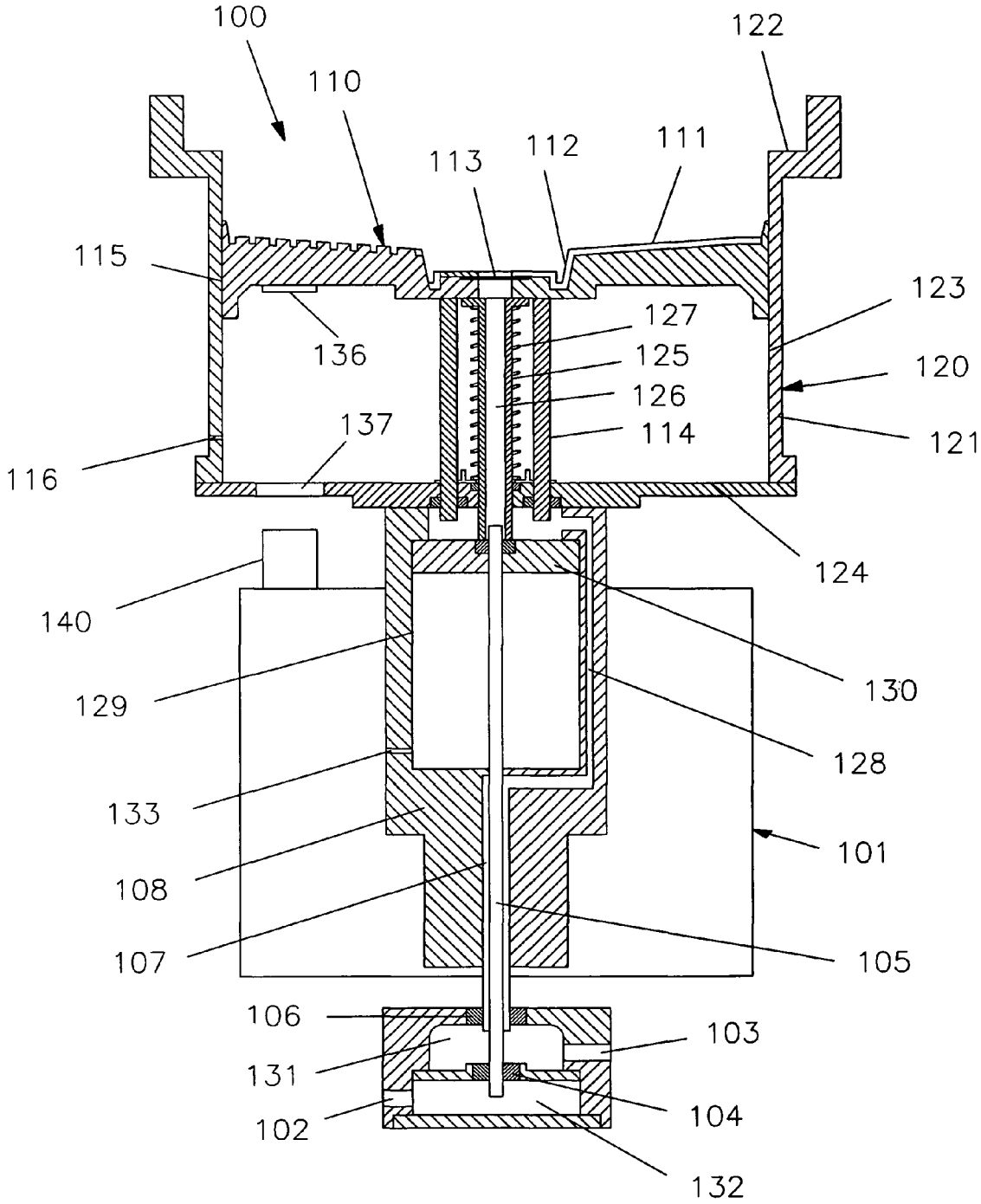

A cross sectional view of the chuck and a piston assembly of the centrifuge system 100 is shown in FIG. 4. A bucket 120 is mounted on a shaft 108 that rotates inside a motor 101. The bucket has a cylindrical shape with vertically standing wall 121 and base 124. The wall 121 has a smooth inner surface 123 that permits the chuck to slide freely. The wall has a shoulder 122 to seat the rigid cover of the rotor. At least one small opening 116 is located at the wall in the vicinity of the bucket base to stabilize the pressure inside the bucket when the chuck slides in the vertical direction. The bucket base that is securely attached to the centrifuge shaft defines an opening at its center permitting a piston rod 125 to slide through. The upper end of the piston rod is attached to the chuck 110 that is situated inside the bucket. The other end of the rod is fastened to the piston plate 130 that slides inside the piston cylinder 129. The piston cylinder is embedded inside the motor shaft 108. The piston cylinder has an air-bleeding orifice 133 to constantly maintain the opposite side of the piston plate at atmospheric pressure.

Referring to FIG. 4, passageways 107 and 128 that are also embedded inside the shaft, furnish the compressed air to activate the piston. The chuck is rested on top of the piston rod and travels vertically up and down therewith. At least one anti-rotation rod 114 is secured to the chuck in parallel to the piston rod with which it slides into the piston cylinder through a sealed opening. The anti-rotation rod ensures that the chuck rotates with the shaft and the bucket at the same speed. Although the chuck is restricted to rotate with the shaft and the bucket, it also has the freedom to travel vertically with relative to both components. The chuck sliding surface 115 and the bucket wall inner surface 123 confine the vertical travel of the chuck. A balanced force between the piston and the combination of the return spring 127 and the tensile strength of the rotors stretched wall; controls the chuck movement. Passageway 107 that supplies pressurized air to the piston is concentric to the shaft and both have the same axis of rotation. The passageway 107 extends out of the shaft and the rotating assembly and penetrates a stationary high-pressure chamber 131 through a rotary seal 106. High-pressurized air is furnished from an outside compressor to the high-pressure chamber through port 103.

FIG. 4 also shows a distance measuring device140 situated at fixed location underneath the bucket base. A window 137 set at the bucket base positioned in a manner to allow for an emitted signal from the device to pass through, targets a reflector 136 at the bottom surface of the chuck, and returns back to the device.

The device determines the vertical travel of the chuck that is the same as the stretched distance of the rotor. Therefore, the capacity of the processing chamber is defined.

Referring to FIG. 4, vacuum is utilized to secure the rotor base to the chuck surface 111. The vacuum is supplied to the chuck surface through a cavity 126 inside the piston rod. A passageway 105 extends from the piston rod cavity through piston plate and cylinder, then runs linearly through the high pressure passageway 107 and connects to the stationary vacuum chamber 132 through rotary seal 104. An outside vacuum pump supplies vacuum to the vacuum chamber 132 through port 102. An air filter 113 is positioned between the cavity 126 and chuck surface to allow for clean air suction in the vacuum pump.

Figure 5:
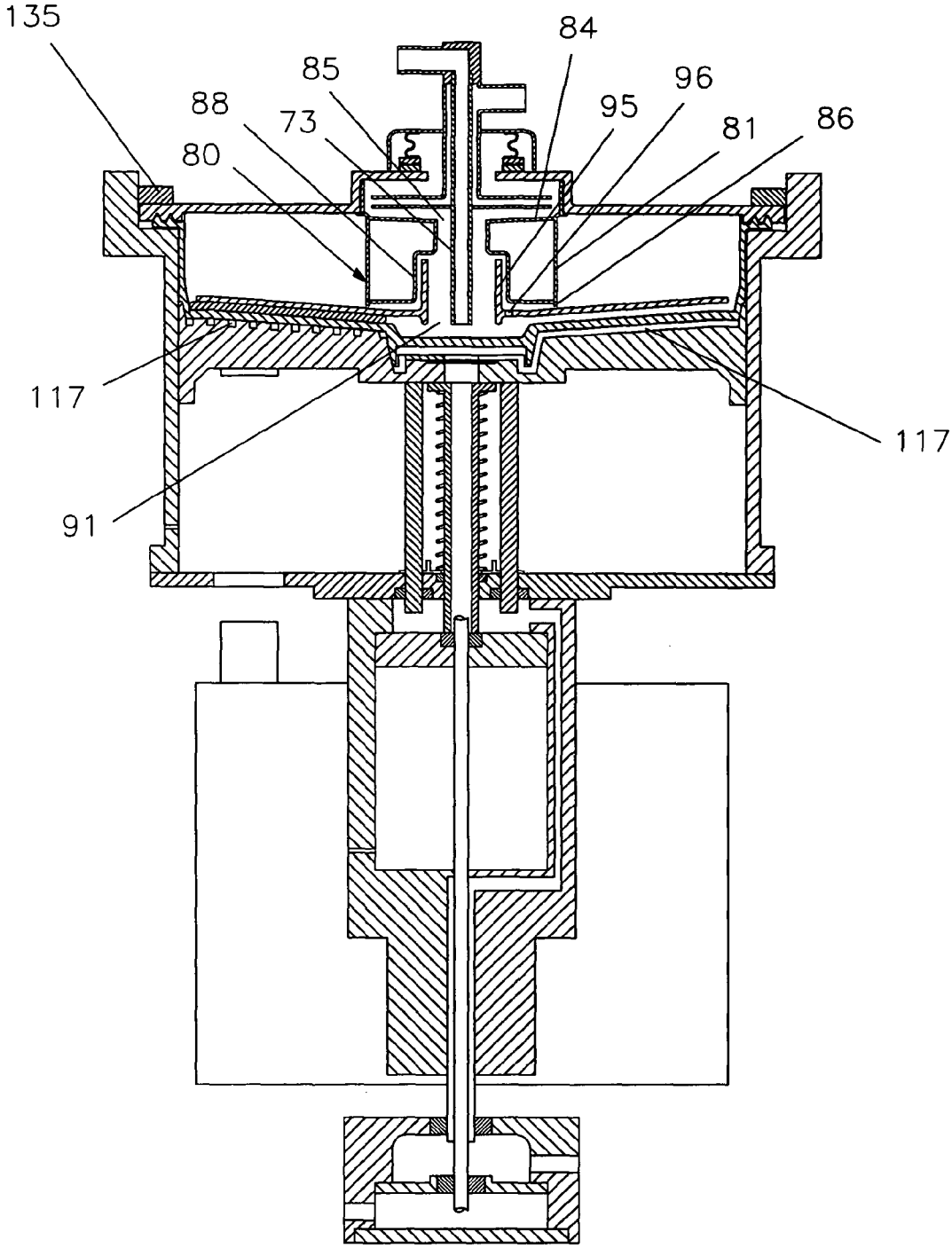

FIG. 5 shows a rotor mounted on a centrifuge system at initial setting. The rotor's rim 63 is rested on the bucket shoulder 122 and a mechanical interlock device 135 captures the rigid cover 50. The rotor base 65 is centered in the chuck by the tapered extrusion 62 that is guided by the centering reference 112 on the chuck (FIG. 4), and it is firmly attached to the chuck surface 111 by vacuum means. Chuck surface having grooves and ridges 117 to allow for the vacuum to channel through the whole interface between the chuck surface and the rotor base. These grooves and ridges allow the chuck to have a strong and uniform grip on the rotor's base.

Forces holding the base of the rotor to the chuck surface are large enough to overcome all the forces generated by stretching the rotor wall 66. This flexible wall extends along the rigid bucket wall 121 resting against the inner surface 123. The bucket wall 121 is strong enough to withstand all the centrifugal forces applied by the rotor and its contents at any rotational speed.

FIG. 5 also shows an inner core 88 that geometrically complements the core 80 providing a full body structure. The inner core extrudes from the partition 84 starting at the opening 85 and extends downward close to the bottom of the core then flanges out radially and connects to the bottom of the wall 81 just above the openings 86. Opening 85 is transformed to a cylindrical chimneystack surrounding tubing 73. The flange section of the inner core acts as a barrier preventing any fluid from being trapped inside the core. The rotor also has a splash barrier 95 that forms a cylindrical shaped wall surrounding opening 91 on the diverter. The cylindrical wall is situated perpendicularly with respect to the diverter with a small section extending slightly below the diverter. The portion of the wall above the diverter acts as a funnel for the incoming fluid that pours from tubing 73 when the rotor is stretched. The diverter has an array of equally spaced openings 96 around the circular wall to drain fluid to the bottom of the rotor when the centrifuge is stopped. The small section of the wall that extends below the diverter is utilized to protect the drain openings and prevent the incoming fluid from leaking through. This version of the core and the diverter provides a better control on the fluid flow inside the rotor and prevent any mixing between separated and incoming fluids.

Figure 6:
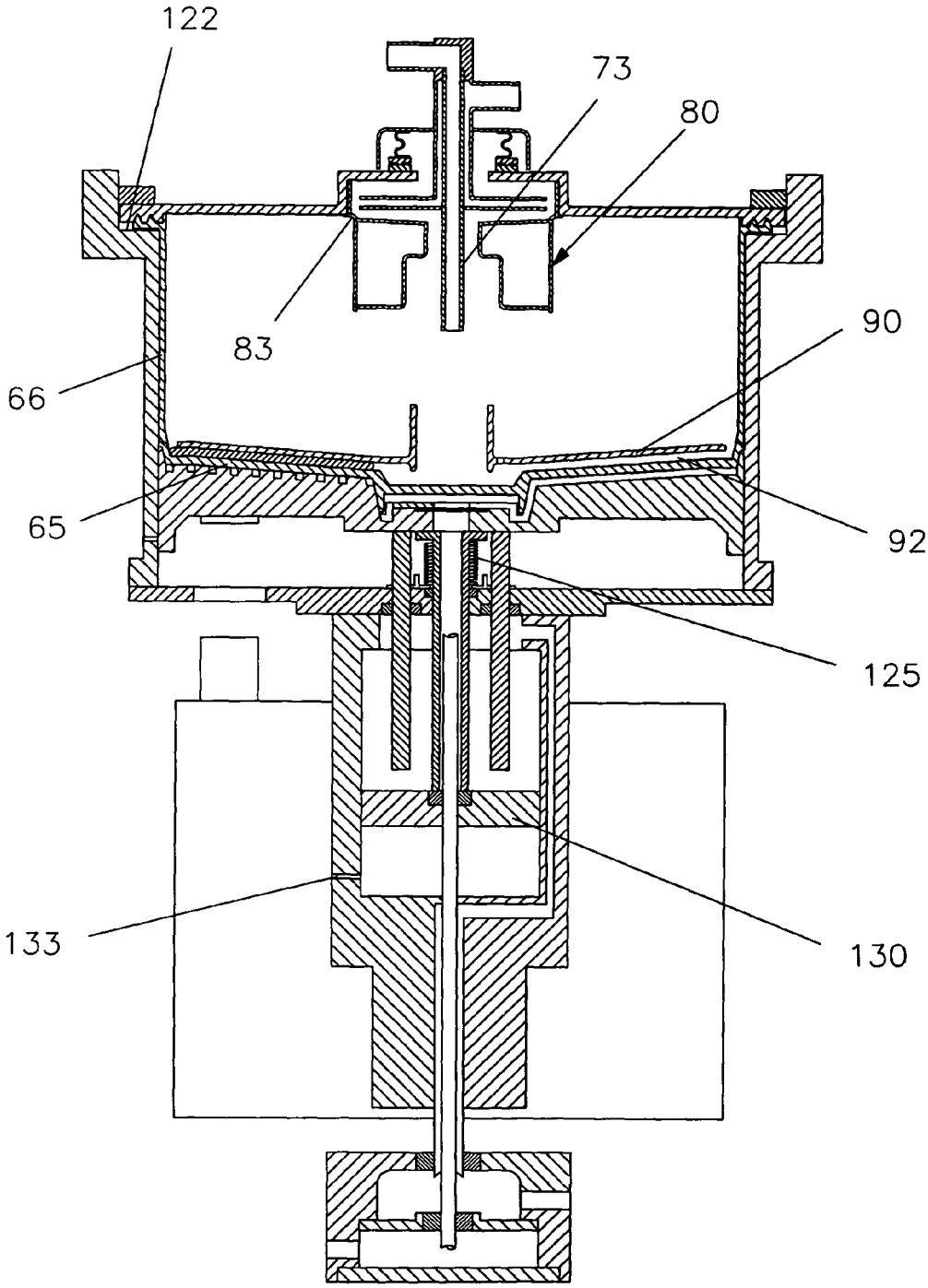

FIG. 6 shows a stretched rotor having a larger capacity. The pressurized air moves the piston in the downward direction pulling the chuck in the same direction. The chuck slides gently on the bucket wall and drags the tightly held rotor base with it. As the compressed air moves the piston plate 130 down the air on the opposite side of the plate is maintained at atmospheric pressure by an orifice 133 that allows the air to communicate with the atmosphere. The piston has enough force to overcome the return spring 125 force combined with the tensile force of the stretched rotor wall 66. As the chuck moves down, the chuck return spring is compressed and the rotor wall is stretched. The rotor base 65 and the diverter 90 move with the chuck maintaining the channel 92 intact between the two entities. The core 80 and the tubing 73 are maintained in their positions as they are integrated with the rigid cover that remains rested on the bucket wall shoulder 122. When incoming fluid enters the rotor through tubing 73, it drops by gravity from the end of tubing 73 to the center bottom of the rotor. Then flows radially outward to the periphery of the processing chamber through the channel 92 between the base and the diverter. As the processing chamber is filled by the incoming fluid, the air fluid interface moves radially closer to the center until it reaches the openings 83 that channel the exiting fluid in to the atrium chamber to be driven through the effluent discs to the exit port.

Figure 7:
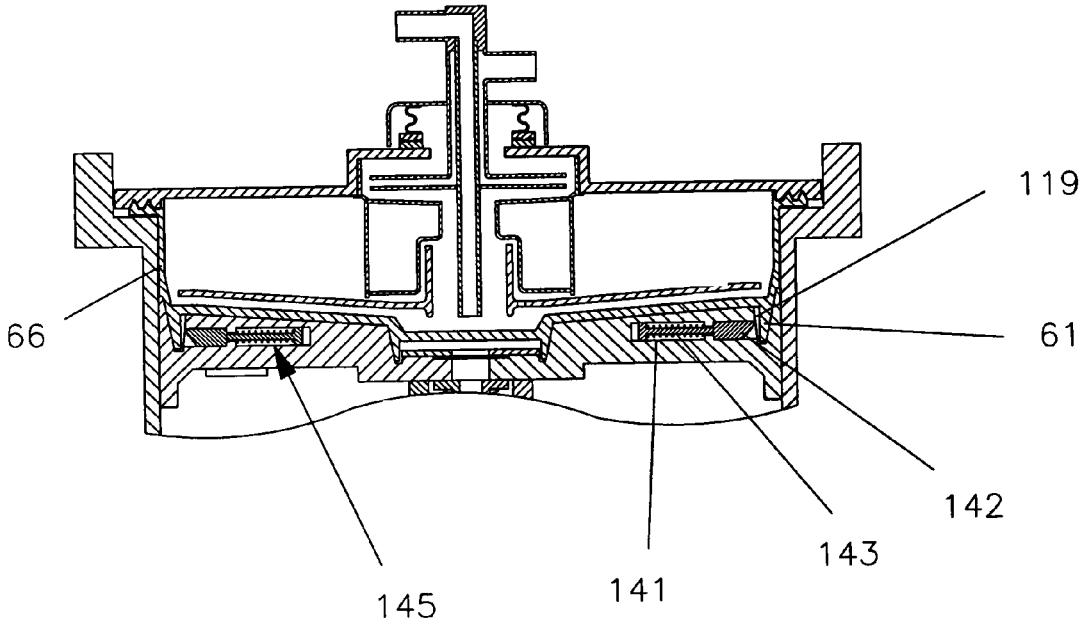

FIG. 7 shows centrifugal clutching mechanism between the base of the rotor and the chuck. The base of the rotor has a clutching circular lip 61 at the perimeter that is situated in a circular groove 119 on the chuck. An array of equally spaced centrifugal clutch assemblies 145 are embedded inside the chuck pointing radially outward. A mass 142 that slides inside a radial tunnel 141 is compelled by centrifugal force to thrust against the clutching circular lip 61 therefore gripping tightly on the rotor base. The mass 142 is large enough and appropriately positioned from the axis of rotation to generate enough centrifugal force to compress the return spring 143 and firmly hold the rotor when the centrifuge is spinning. The return spring 143 has enough force to return the mass 142 completely back inside the tunnel 141 when the centrifuge is stopped clearing the way for the clutching lip 61 to be removed from the groove 119 or to be reinserted in. This centrifugal clutching with or without vacuum is capable of producing a tight grip on the rotor base enough to allow for the stretching of the flexible vertical wall 66 a multiple times of its original height.

In another embodiment an array of equally spaced pneumatic pistons embedded radially at the periphery of the chuck are used to secure the rotor to the chuck. The pistons are energized by a compressed air supplied by passageway 107 (as shown in FIG. 4). The pistons are used to grip on the circular lip 61 at the bottom of the rotor and secure it inside a circular groove 119.

Figure 8:
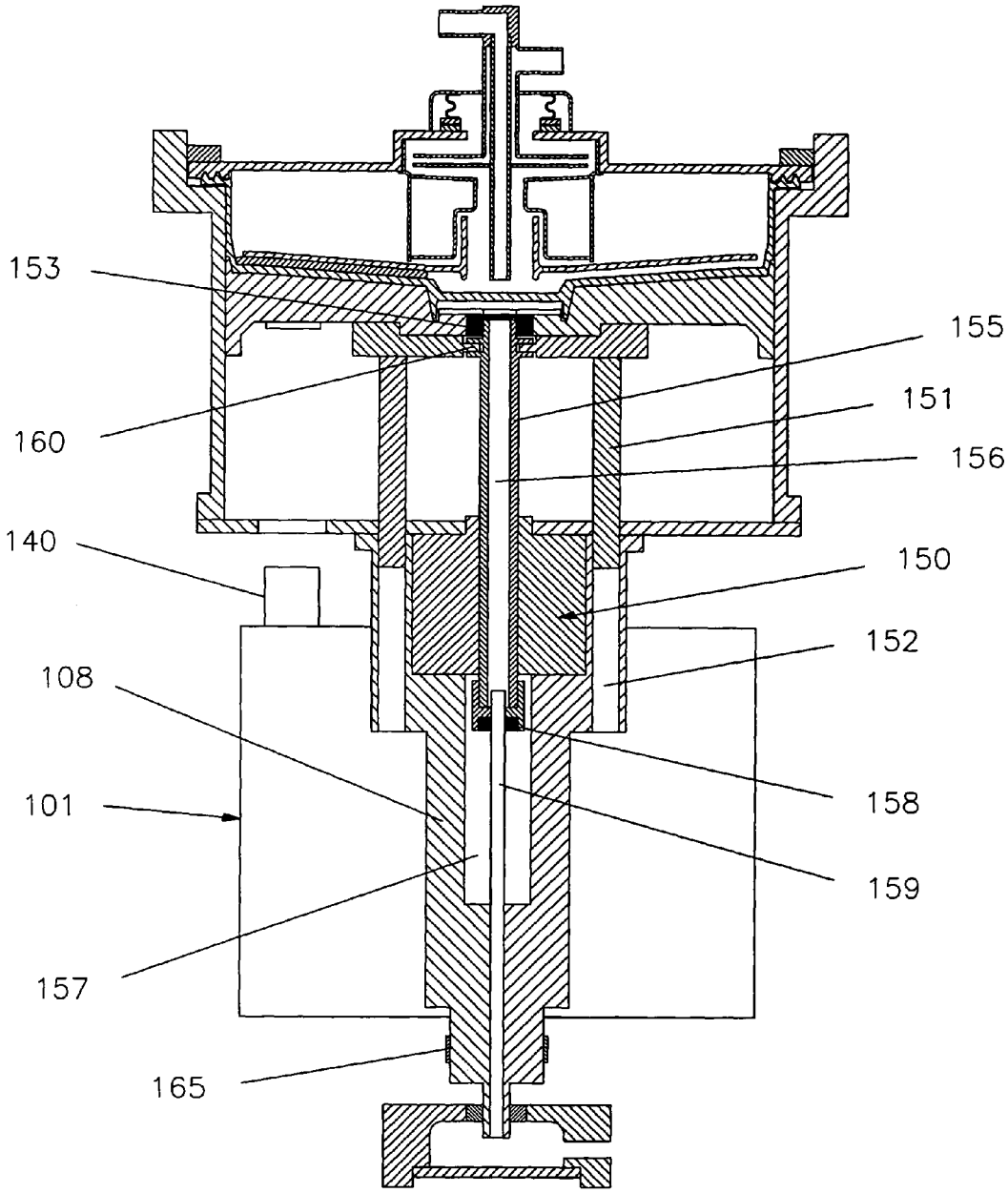

FIG. 8 shows a centrifuge system encompassing a linear motor 150 with a linear screw 155 to vertically displace the chuck. The motor is embedded in the axel and spins with it. The linear screw is positioned upright at the center of the axel having the same axis of rotation. The upper end of the screw is connected to the base of the chuck by a circular tong and groove interlock 160. This interlock allows the screw to rotate freely with respect to the chuck while it is pulling down or pushing up the chuck. Anti-rotation rods 151 extending from the chuck having the other end inserted in a cylindrical cavity 152 on the axel enough to prevent the chuck from rotating with the linear screw. As the chuck moves down, each rod slides down inside a cavity 152 until the chuck is stopped. The cavity is deep enough to accept the full length of the rod. As the linear screw is driven down to pull the chuck, it is housed inside a cavity 157 at the center of the axel 108. Vacuum is supplied to the chuck surface from an outside source and a rotary seal is used to transfer it to the rotating assembly.

Figure 9:
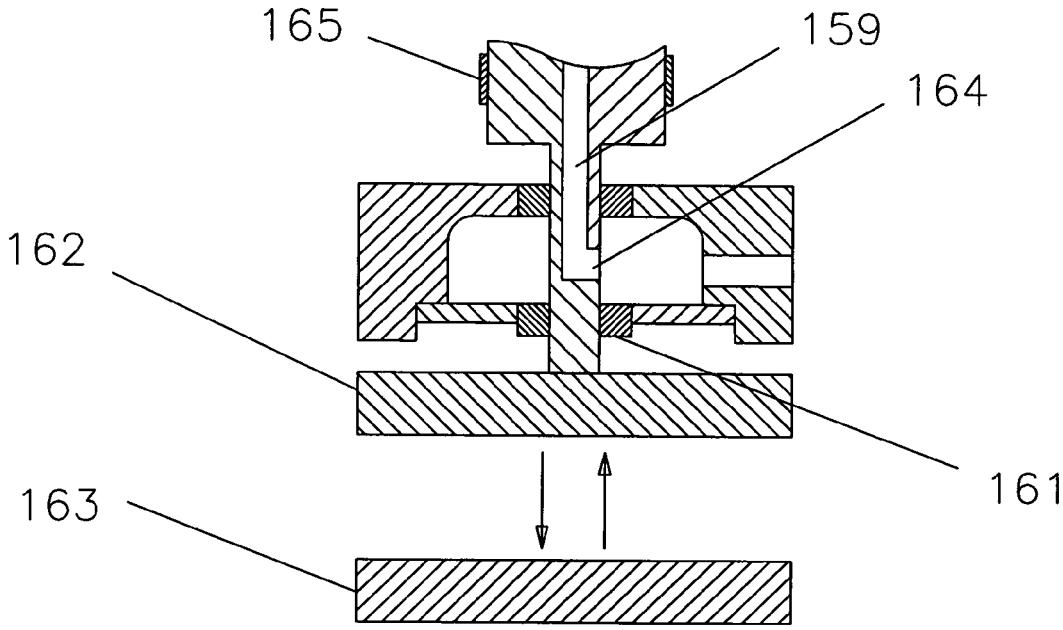

A conduit 159 conveys the vacuum through the axel all the way to the vicinity of the motor. The linear screw has a hollow cavity 156 at its center that can slide over the conduit. As the linear screw moves up and down it slides over the conduit in and out. The combination of the conduit and the screw cavity form a telescopic path for the vacuum to reach the surface of the chuck. A seal 158 is used at the end of the linear screw where it engages with the conduit 159 to secure the vacuum inside the telescopic path. A similar seal 153 is used at the top end of the linear screw where it is connected to the chuck to secure the vacuum within. In this embodiment the rotor base is clutched to the chuck by vacuum. The motor is energized by slip rings 165 at the bottom of the axel and the linear screw 155 rotates pulling the chuck down. The position of the chuck is monitored by a distance-measuring device 140, which transmits the data to a controller that regulates the motor speed and determines when to start and stop the motor. In a preferred embodiment a step motor is used to displace the chuck. Therefore, the actual number of steps that the motor turns determines the position of the chuck. All signals provided to the step motor are transferred by slip rings or by wireless transmitted signals such as infrared (IR) or radio frequency (RF) positioned at the bottom of the axel. As shown in FIG. 9, a rotating emitter receiver 162 is attached to the bottom of the rotating axel. A matching stationary emitter receiver 163 is positioned to communicate wireless signals to the rotating assembly. In this embodiment, the vacuum is channeled to the vacuum conduit 159 through a port 164 on the axel. A rotary seal 161 is utilized to protect the vacuum integrity. As it was previously explained, the position of the chuck determines the capacity of the processing chamber.

In another embodiment a pneumatic motor built with a linear screw is used to displace the chuck. The pneumatic motor is embedded in the rotating shaft and is energized by a compressed air supplied by passageway 107 (as shown in FIG. 4).

Figure 10:
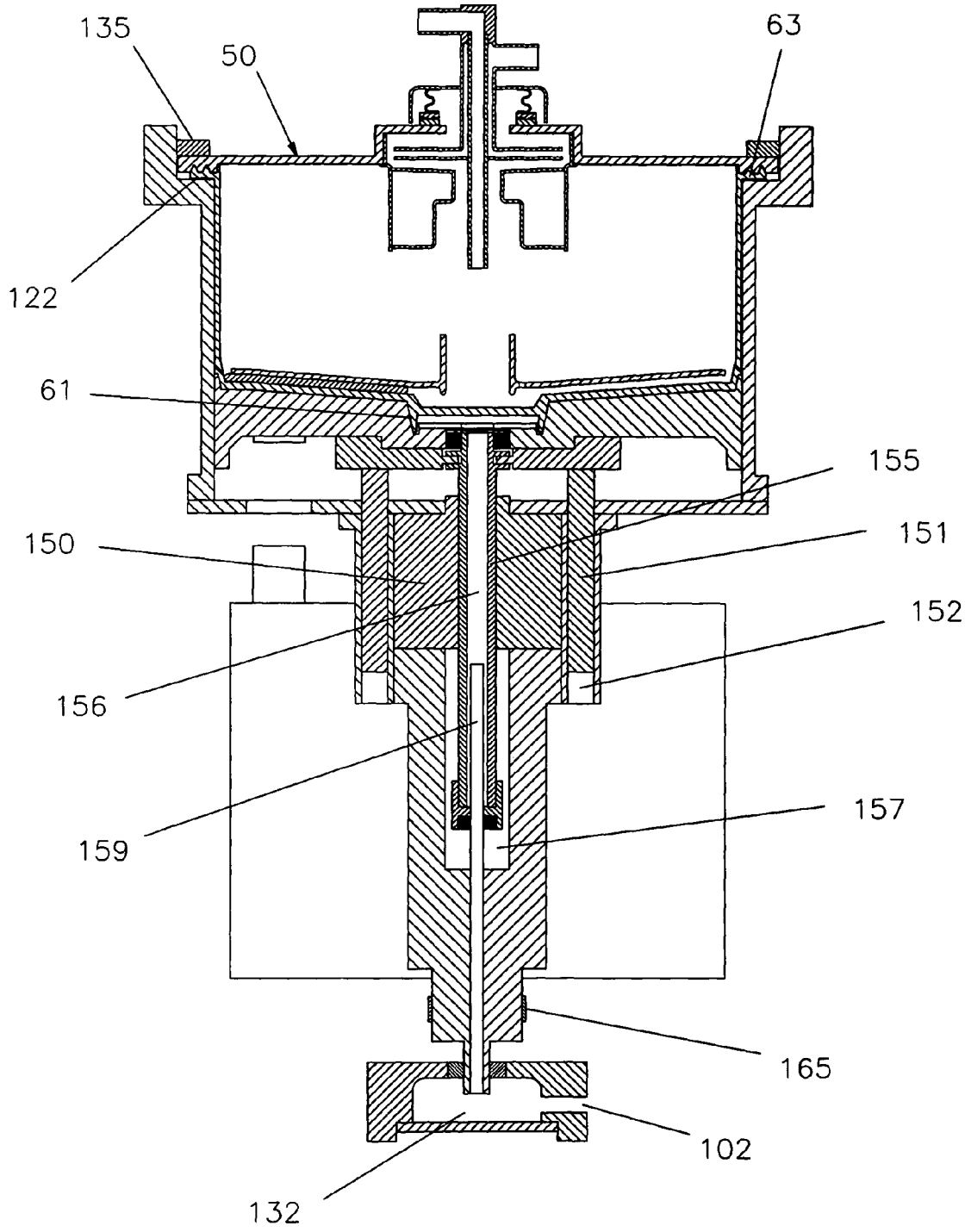

FIG. 10 shows a cross sectional view of a stretched rotor mounted on a centrifuge system encompassing a linear motor 150. When the motor is activated to pull the chuck downward, the vacuum conduit 159 slides telescopically inside cavity 156. The linear screw 155 moves inside cavity 157. The anti-rotation rods 151 are inserted inside the cylindrical cavities 152 on the axel.

When a rotor is placed in a centrifuge bucket, the tapered extrusion 61 at the center of the base guides the rotor base to be centered on the chuck. The overhang rim 63 is rested on the bucket wall shoulder 122. The mechanical interlock 135 is activated to hold the rotor's rigid cover 50 to the bucket wall shoulder. An outside pump positioned at a distant from the rotating assembly activates the vacuum. The pump generates vacuum between the rotor base and chuck surface through port 102, chamber 132, passageway 159, and cavity 156. The generated vacuum holds the base tightly to the chuck. The centrifuge starts spinning. The rotor, the bucket, the chuck, and the shaft rotate simultaneously at the same speed.

Figure 11:
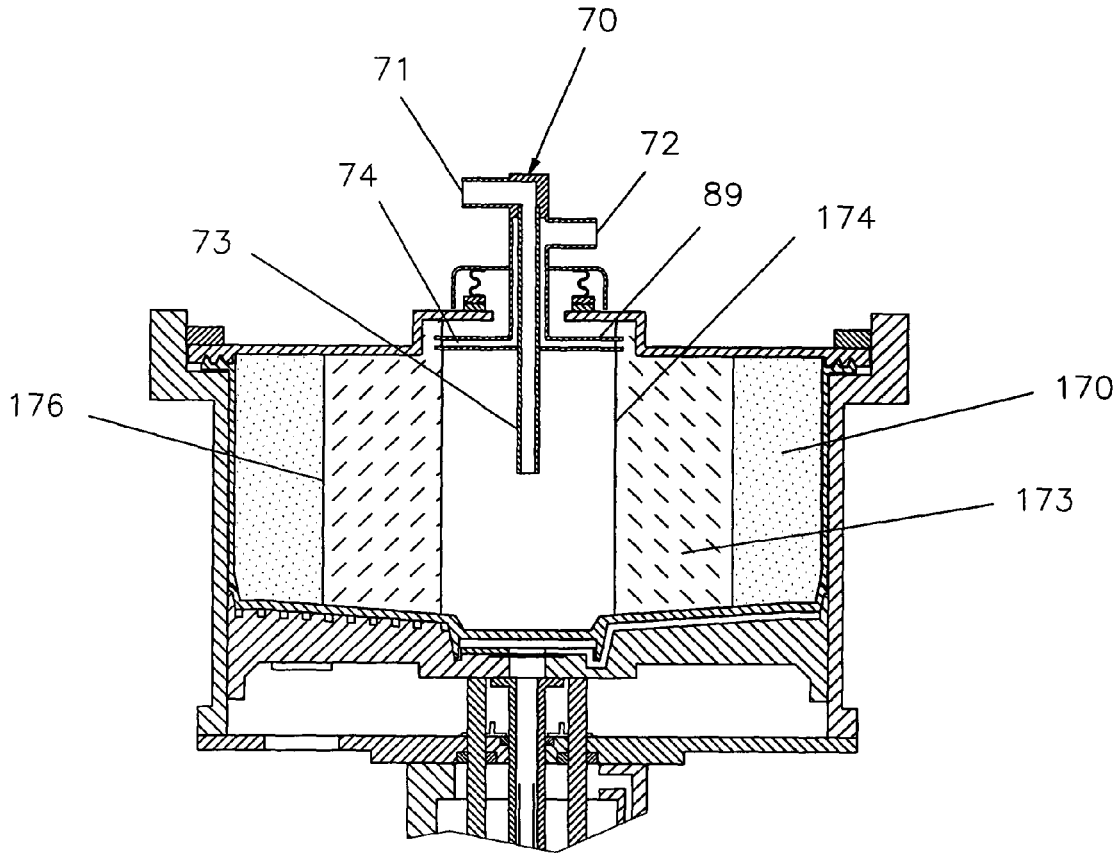
Figure 12:
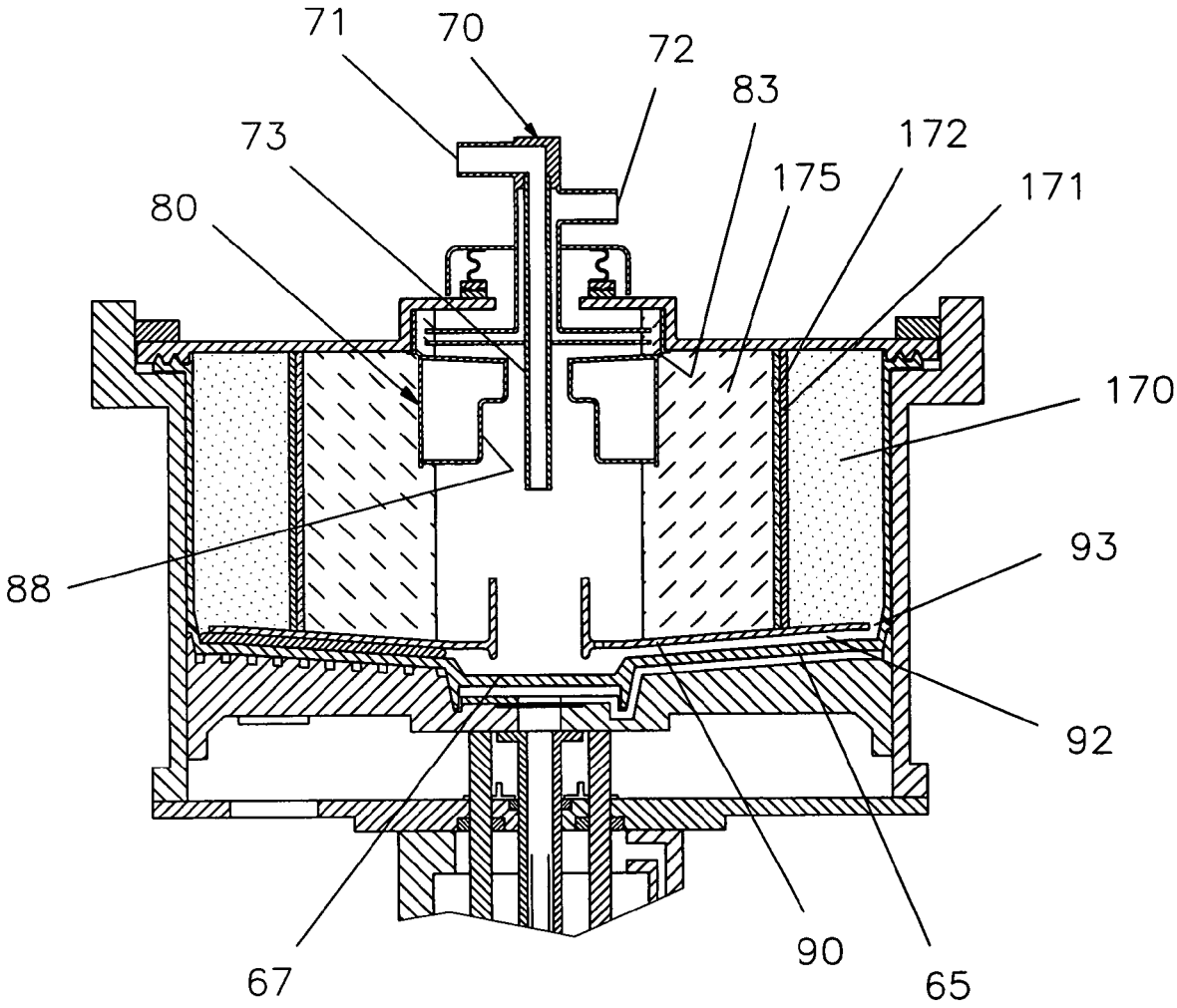

Referring to FIG. 11 and FIG. 12, whole blood that is drawn from a donor or salvaged from a patient during or post surgery is introduced to the rotor through the stationary fluid channeling assembly 70 and more particularly through the inlet port 71. Gravity or pumps are used to drive the blood into the rotor. The whole blood flows from the inlet 71 through the stationary tubing 73 and pours in the circular depression 67 at the center of the rotating rotor base 65. After sufficient blood enters the rotor, the rotor is spun quickly enough and long enough to cause adequate separation. The blood rushes by centrifugal forces to the periphery of the processing chamber where it is separated to red blood cell (RBC), buffy coat (BC) that is a mixture of platelets and white blood cells (WBC), and plasma. These components having different densities are separated in different layers depending on the centrifugal speed. At high speed (FIG. 12), RBC of the highest density are concentrated in a layer 170 that is the farthest away from the axis of rotation. The WBC with the second highest density are concentrated in a layer 171 supported by the RBC layer and positioned closer to the axis of rotation. The platelets with a density slightly less than that of the WBC are clustered in a layer 172 adjoining the WBC closer to the axis of rotation. Plasma 175 with the least density is packed in a layer the closest to the axis of rotation. At moderate speed (FIG. 11), RBC having some WBC are concentrated in an outermost layer 170, and a mixture of plasma, WBC, and platelets called platelets rich plasma (PRP) are concentrated in a layer 173 closer to the axis of rotation.

In order to avoid excessive vibration of the system as the rotor is being spun, the speed of rotation may be varied. For instance, instead of trying to maintain a constant speed of rotation of 5000 rpm, the motor may cycle through a range of speeds around 5000 rpm. This cycling will help avoid the motor staying at a rotational speed that puts the system into a resonant vibration. The rotational speed should be changed quickly enough so that the system does not have an opportunity to resonate at a given speed, yet the speed should not be changed so quickly that the separation of the fluid components is upset.

Depending on the volume of the processed blood, the chuck starts to move downward stretching the wall of the processing chamber to increase its capacity. Referring to FIG. 6, a compressor distant from the rotating assembly generates pressurized air that is fed to the piston through port 103 and passageways 107 and 128. As the pressure of the compressed air increases gradually, the piston plate 130 start to move downward slowly pulling the chuck down, compressing the return spring 125, and stretching the rotor's flexible wall 66. This movement takes place without compromising the vacuum state that tightly holds the rotor's base 65 to the chuck surface 111, as the piston plate 130 with a seal 134 slides over the vacuum passageway 105 that is accepted telescopically inside the piston rod cavity 126. When the desired capacity of the processing chamber is achieved, the chuck vertical movement is stopped and the air pressure inside the piston persists at constant level. The flow of the incoming blood into the rotor is maintained, and the separated layers continue to grow. Referring to FIG. 11, as the plasma layer grows, the air plasma interface 174 converges radially inward and bypasses the atrium until it attains the edge of the stationary effluent discs 89. The incoming whole blood forces out a corresponding volume of plasma. The centrifugal forces applying radial pressure on the air plasma interface compel the plasma to flow into the stationary effluent channel 74 and to exit the rotor from the outlet port 72. The exiting plasma can be collected in a separate bag that has a sterile connection to the exit port or simply returned to the donor. Equilibrium is reached between the intensity of the exiting plasma flow and the position of the air plasma interface. If the exiting flow is restricted while incoming blood is pumped into the rotor, the air plasma interface moves radially inward. If the flow is unrestricted, the air plasma interface is positioned at the edge of the effluent discs.

As the incoming blood continues to flow in and the plasma proceeds in exiting the rotor, the RBC layer persists in growing while the plasma layer is dwindling and the plasma RBC interface 176 steadily moves radially inward. At some point the rotor's processing chamber may become filled with RBC. Typically, the centrifugation process stops when the plasma RBC interface reaches a certain distance from the axis of rotation beyond which it no longer can maintain the separation edge between the two components. The centrifuge stops when an optic sensor 215 (FIG. 13) focusing at a spot on the rigid cover located at a specific distance from the axis of rotation; detects the RBC layer. Or, when a Fluid Density sensor 210 detects RBC in the exiting flow.

Figure 13:
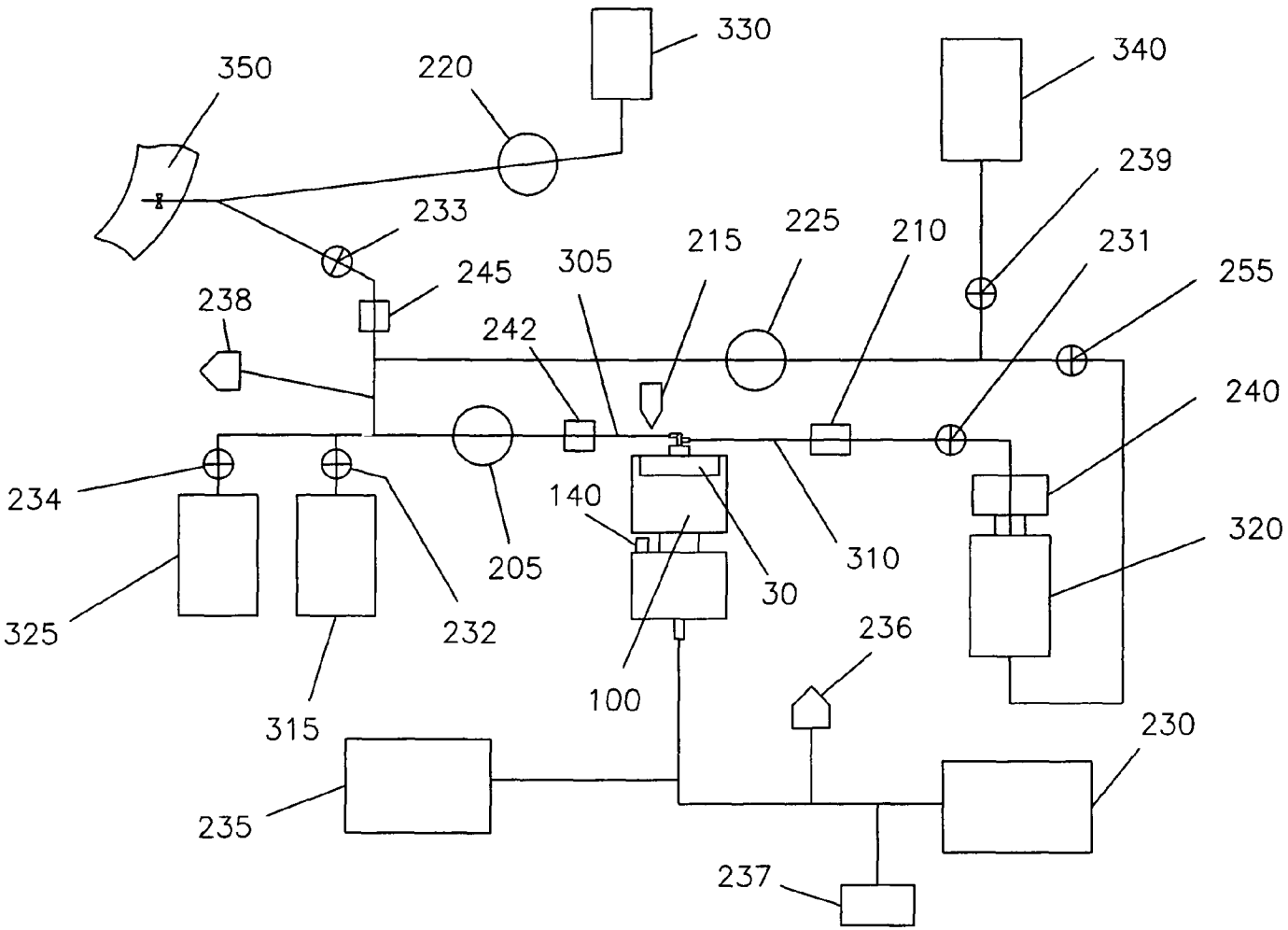

As the centrifuge stops the concentrated RBC is settled by gravity at the bottom of the rotor. A pump 205 (FIG. 13)

connected to the inlet port 71 (FIG. 2 & FIG. 3) starts to drive the RBC from within the rotor out through tubing 73. When the level of RBC reaches below the tip of tubing 73, the chuck (FIG. 5) moves slowly upward at a rate to ensure the continuity of the RBC flow through the exit port. The pressure in the piston starts to drop gradually allowing the return spring to expand and move the chuck slowly in the upward direction causing the stretched rotor wall to retract accordingly. As the chuck returns to the initial setting the tip of the feed tubing 73 is positioned at a close distance to the bottom of the processing chamber and particularly adjacent to the surface of the circular depression 67 at the center of the base. This allows the pump 205 to drive all the RBC out of the rotor to be stored in a sterile bag or to be returned to the donor.

It is a distinctive advantage of the current invention that the rotor permits the processing of a very small amount of blood up to the maximum amount permitted by the rotor. As noted previously, prior-art systems using fixed-volume rotors require that a fixed amount of blood be processed. With the variable-volume rotors 30, a donor may be allowed to donate less than a standard unit of RBC, which is advantageous in many situations, such as children and other donors with low body weight. When the flow of the incoming blood is terminated prior the optic sensor 215 detecting the RBC plasma interface line. The chuck automatically adjusts its position to always bring the RBC plasma interface line to a specific spot to be detected by the optic sensor. This process forces the excess plasma out of the rotor until the desired concentration of remaining products is achieved.

Referring to FIG. 12, the rotor having a diverter 90 and a core 80. When the incoming blood is discharged from the feed tubing 73, it drops by gravity to the bottom of the rotor at the circular depression 67, and then rushes radially outward to the perimeter by centrifugal force through channel 92 defined between the rotor base 65 and diverter 90. The blood enters the separation chamber through an entrance 93 at the periphery of the rotor to ensure a perfect sedimentation of the RBC at the outermost radius. Blood components having different densities are separated into distinctive layers in the processing chamber. As the plasma layer grows, the plasma air interface 174 converges radially inward until it reaches the exiting fluid opening 83 on the core. The plasma is channeled in to the atrium through opening 83 and pushed out through the effluent discs 89 to exit the rotor from the outlet port 72.

The present configuration shown in FIG. 12, in addition to apheresis applications, is best suited for RBC salvaging or fluids treatment applications such as cell washing, enzymatic conversion, pathogen inactivation, glycerolization, and deglycerolization. The diverter guides the treatment fluids such as saline or glycerol to enter the processing chamber from the outermost radius to be thoroughly mixed with the sedimented cell layers as it flows radially inward. As the cells are treated with excess fluid, the flexibility in adjusting the rotor's volume permits the final product to have the required hematocrit. As the chuck moves upward in successive steps to gradually reduce the volume of the rotor, the excess fluid is pressed out of the rotor. It is possible in some occasions that the rotor's volume change does not correspond the exiting flow rate, this forces the air fluid separation line to move radially inward beyond the exiting channels 83 on the core. In this case, the inner core 88 acts as a barrier preventing fluid entrapment inside the core and holds the fluid in check until it is pushed radially outward back to the exiting channels.

FIG. 13 shows a schematic drawing of a system to utilize the rotor 30 described above in a donor-connected apheresis system for the collection of one or two units of RBC. Blood is drawn from a donor arm 350 by a needle that is inserted into a vein. A metered anticoagulant fluid is driven by a peristaltic pump 220 from anticoagulant bag 330 to the needle site to be mixed with the fresh blood to prevent any coagulation. The anticoagulated blood is driven by a peristaltic pump 205 through a sterile tube 305 to be discharged into the rotor that spins at a defined speed. As the blood is separated into RBC and plasma layers inside the processing chamber, the chuck starts to move downward to increase the capacity of the rotor. An outside compressor 230 supplies the needed pressure to move the chuck downward. Also, an outside vacuum pump 235 ensures the chuck gripping on the rotor base and displacing it downward with the chuck. Hence, the rotor volume increases by vertically stretching the wall. The flow of the incoming blood is continued, the plasma starts to exit the rotor and it flows through sterile tubing 310 that is mounted to a fluid density detector 210. The plasma is collected in a plasma bag 320 until the optic sensor 215 detects the RBC layer. This is a sign that the rotor is filled with concentrated RBC to its maximum limit and the corresponding plasma is collected in the plasma bag. A signal is sent to the controller (not shown) to stop the centrifuge, stop the flow of the incoming blood by stopping the collection pump 205 and the anticoagulant pump 220, and close the donor valve 233. Plasma valve 231 remains open to allow for the displaced air to return to the rotor when the RBC are pumped out. The system proceeds in recovering the concentrated RBC from the rotor by opening the RBC valve 232 and turning the peristaltic pump 205 in the reverse direction. As the peristaltic pump can calculate the volume of fluid it processes. The controller allows the chuck to move up slowly to retract the volume of the rotor by the same amount that was processed by the pump. This is done as the controller allows the pressure to drop inside the embedded cylinder 129 by activating the bleeding valve 237. Hence the chuck moves upward as the piston plate 130 moves upward. The controller allows the pressure to drop in successive steps in coordination with the pressure transducer 236 that monitors the pressure and sends feedback to the controller to achieve a smooth movement of the piston. At the same time, the distance measuring device 140 records the actual displacement of he chuck and informs the controller which calculates the retracted volume of the rotor and compares it to the processed volume by the pump. This continues until the rotor reaches its initial volume. The pump continues to drive the RBC out of the rotor until an air detector 242 positioned between the rotor and the pump confirms the transfer of all RBC to the collection bag 315. The pump stops and the RBC valve 232 is closed. If the plasma needs to be returned to the donor, plasma valve 231 is closed, plasma return valve 255 is opened, donor valve 233 is opened and a peristaltic pump 225 drive the plasma back to the donor through an air detector 245 that stops the pump 225 and closes the donor valve 233 if it detects an air bubble in the returned fluid flow.

If a second unit of RBC needs to be collected from the same donor, the whole process is repeated again except when the RBC is driven out of the rotor, valve 232 remains closed and valve 234 is open to direct the RBC to a second RBC bag 325.

It is sometimes desirable to replace the blood volume given by the donor by replacement fluid such as saline. This can be accomplished by utilizing the plasma pump 225 to simply pump saline to the donor. As shown in FIG. 13, saline valve 239 is opened, plasma return valve 255 is closed, and the pump starts to meter saline from bag 340 to be infused into the donor. Air detector 245 monitors the saline flow to ensure the absence of any air bubble in the infused replacement fluid.

If plasma were to be collected instead of RBC, the plasma that emerges out of the rotor is stored in a plasma bag 320 that is mounted on a scale 240 to indicate the collected plasma volume. If enough plasma is collected in the plasma bag, the scale transfers the information to the controller that stops the blood flow. RBC valves 232 and 234 remain closed the donor valve 233 is opened. The peristaltic pump 205 starts driving the RBC from the rotor back to the donor as it is previously explained. The RBC flows through the air detector 245 that ensures no air bubble is infused into the donor. When all RBC are returned, pump 205 stops and donor valve 233 and plasma valve 231 are closed.

In some applications it is desirable to collect a unit of plasma and a unit of RBC. The plasma is stored in the plasma bag 320 as it is explained above and the RBC that are concentrated in the rotor are collected in the RBC bag 315. In this case no plasma or RBC are returned to the donor, but replacement saline could be administered to the donor as it is explained above.

It is safe practice to utilize a pressure sensor 238 to monitor the pressure on the line that connects the donor to the system. The blood flow from the donor and the fluid flow back to the donor are monitored and controlled to prevent any damage might be caused by excessive pressure.

A controller (not shown) comprising a digital data processor is preferably used to monitor and control the Whole system, subsystems, modules, and components. The controller oversees all the operations and synchronizes all actions as it follows programmed protocols and certain sets of instructions and commands. The controller manages centrifuge speed, pumps speeds and directions, valves status, compressed air pressure, vacuum pressure, chuck position, chuck displacement speed, donor line pressure status, and monitors all pressure sensors, optic sensors, density sensors, air detectors, proximity sensors, and scales. The controller receives and analyzes all data and feedbacks from all modules and sensors, and then it commands all systems and subsystems accordingly and with complete conformity to the programmed protocols. The controller is attached to input/output means to receive instructions and commands and to display or express procedure status by visual audible means.

A variation of the above system that requires a second needle preferably inserted in the donor's second arm, used to return plasma and replacement fluid. This flexibility permits the plasma to be returned to the donor while blood is drawn from the first needle. This variation has the advantage of a shorter processing time that better accommodates the donor's schedules.

Figure 14:
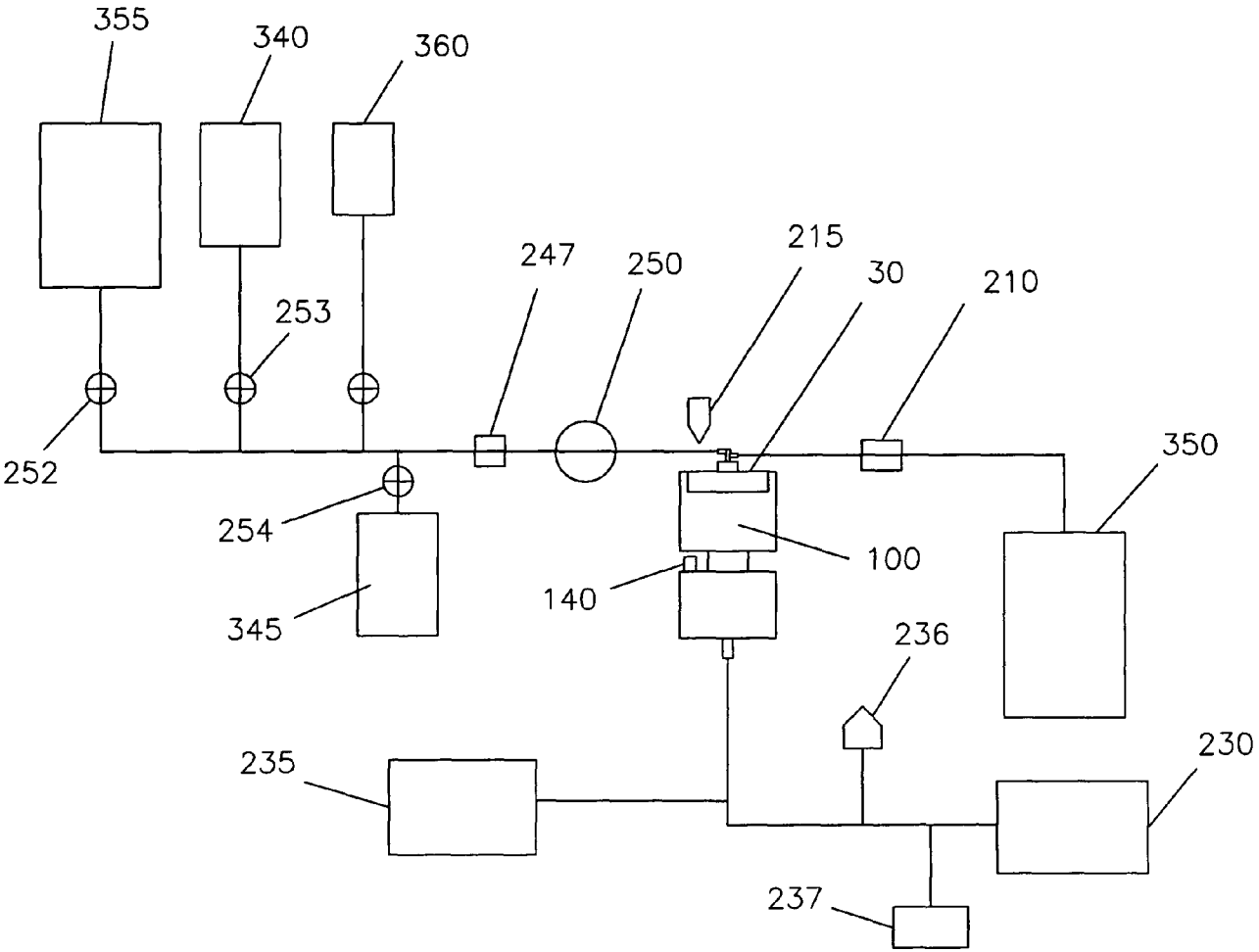

The rotor 30 equipped with core 80 and diverter 90 may also be used to salvage patient's blood during a surgery. The shed blood is normally siphoned by vacuum to be collected in a reservoir where it is mixed with anticoagulant in order to prevent clotting. This blood is typically mixed with fragmented tissues, bone chips, lipids, and it is diluted with irrigation fluids such as saline. A schematic drawing of the blood salvaging system is shown in FIG. 14. The reservoir valve 252 is opened and a pump 250 drives the blood that has collected in the reservoir 335 to the rotor that spins at a defined speed. The chuck starts to move down to expand the rotor capacity. The blood continues to flow into the rotor as the supernatant fluid exits the rotor and is dissipated into the waste bag 350.

Blood flow to the rotor is stopped when the optic sensor 215 detects the concentrated RBC layer at a defined distance from the axis of rotation. Closing the valve 252 stops the blood flow and the saline valve 253 is opened to rush the saline to the rotor. The saline dissipates through the RBC layer and washes out all the debris to be flushed into the waste bag. The pump meters the amount of saline that is used to wash the blood in the rotor. The air detector 247 informs the controller when the saline bag is empty. The pump stops and the saline valve is closed when the desired amount of saline is used to wash the blood. The chuck moves up to retract the volume of the rotor by squeezing the saline out into the waste bag until the fluid density sensor detects RBC. The centrifuge stops, RBC valve 254 is opened, and the pump turns in the reverse direction to transfer all the washed RBC to the RBC bag 345. The pump stops when the air detector 247 senses the end of the RBC flow.

The system shown in FIG. 14 can be utilized to glycerolize concentrated RBC. Operationally, this configuration of the system would work in a manner very similar to that described above except that a concentrated RBC bag replaces the reservoir and the saline is replaced by glycerol. The rotor starts spinning at a low speed and expands to a desired capacity. The concentrated RBC and the glycerol are transferred to the rotor where they are mixed for a period of time. The speed of the rotor is increased to a higher level enough to separate the glycerolized RBC from the excess glycerol. The chuck is moved upward to retract the volume of the rotor and squeezing out the extra glycerol. The glycerolized RBC are transferred to the RBC bag that is frozen at −70° C.

The system shown in FIG. 14 can also be utilized to deglycerolize thawed glycerolized RBC. Just replace the reservoir by a thawed glycerolized RBC bag. In addition to the (0.9% NaCl concentration) saline bag 340, a (12% NaCl concentration) saline bag 360 is added. The rotor starts spinning at a low speed and expands to a desired capacity. The glycerolized RBC and the saline (12% NaCl concentration) are transferred to the rotor where they are mixed for a period of time enough to reach equilibrium. Then saline (0.9% NaCl concentration) is added to the rotor and mixed with the RBC for a period of time and then squeezed out. This cycle could be repeated many times in order to maximize the efficiency of the RBC. Saline (0.9% NaCl) could be used for repeated wash cycles to increase product purity. The deglycerolized RBC are collected in the RBC bag.

Figure 15:
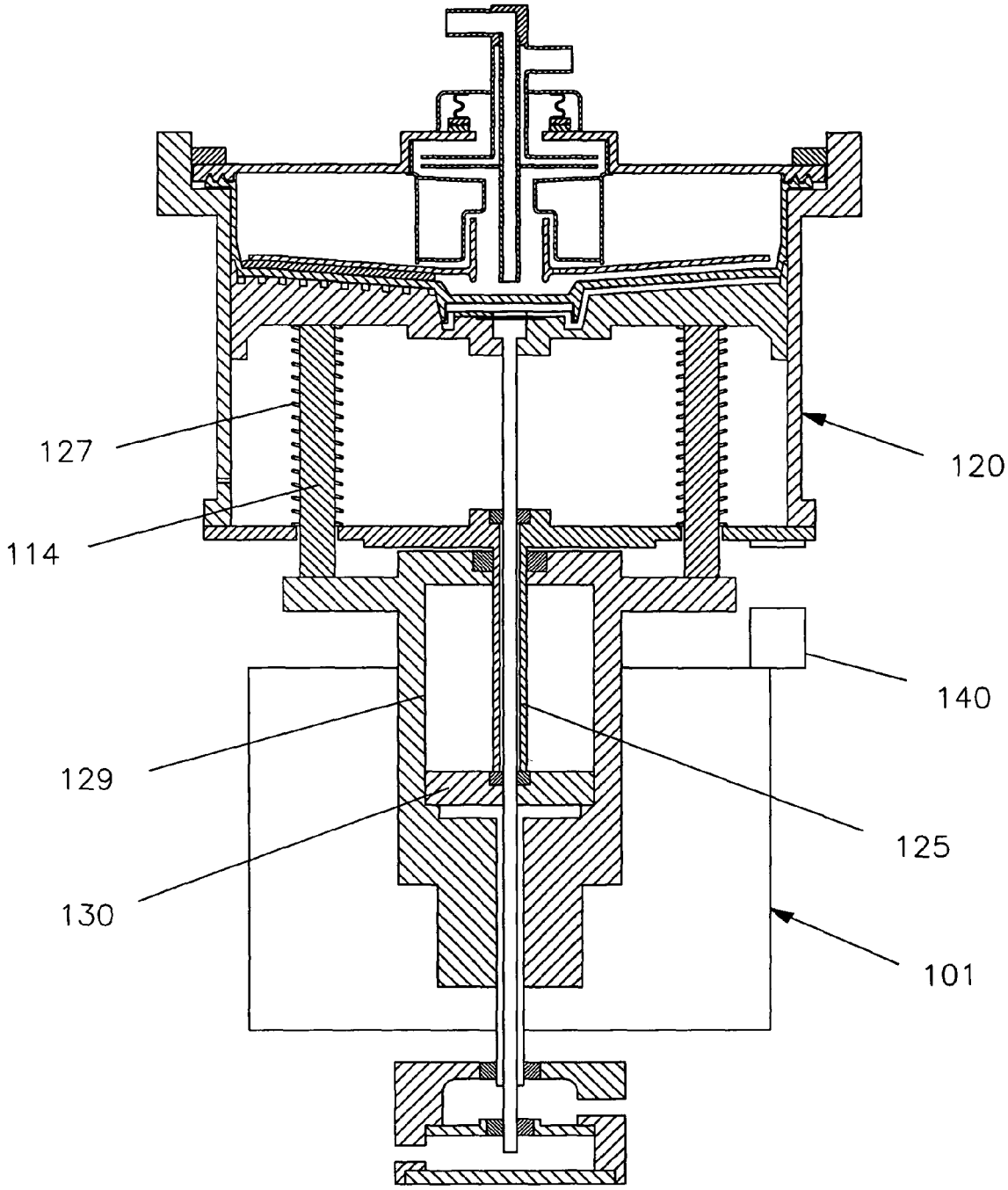
Figure 16:
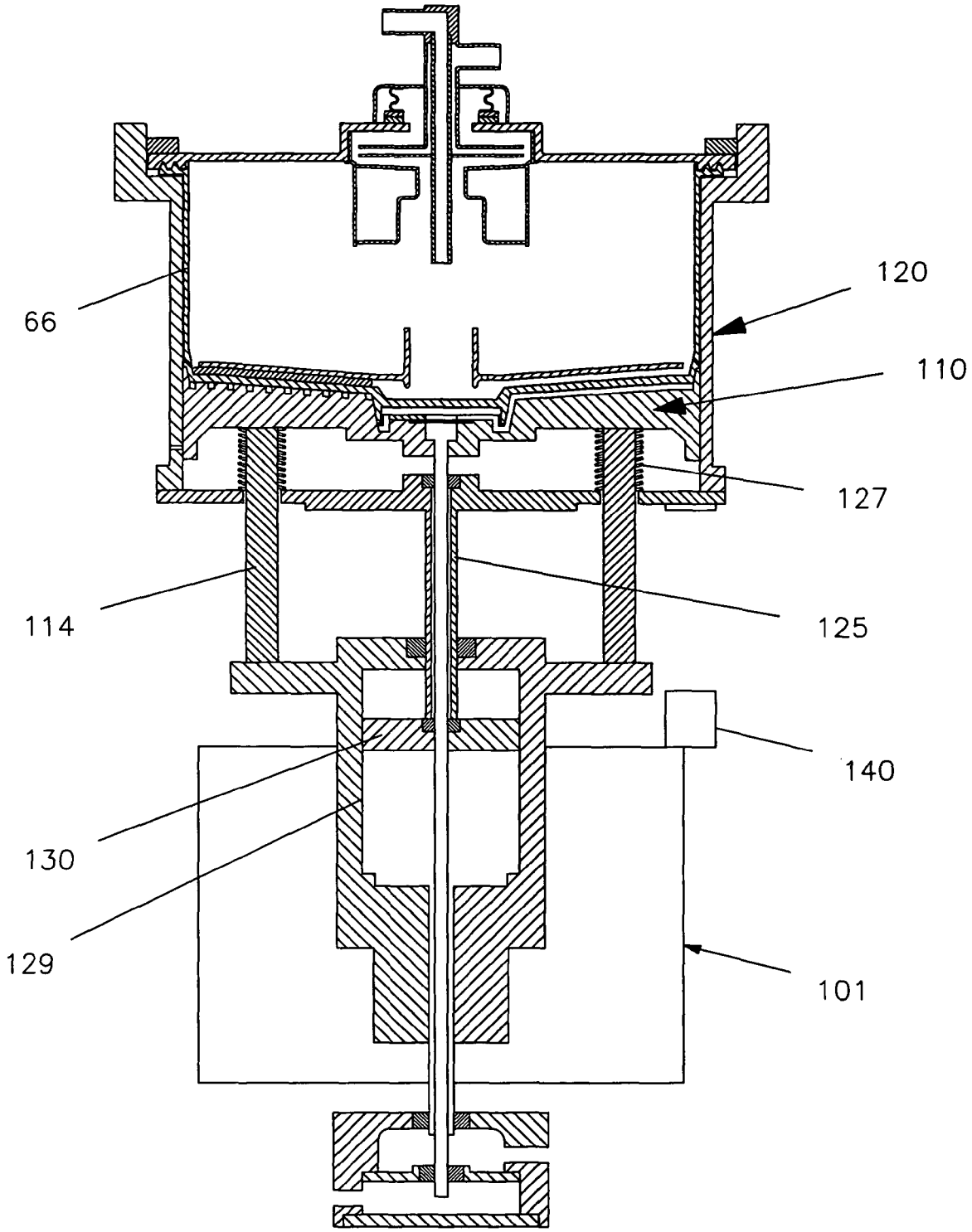

Another embodiment of the centrifuge system is shown in FIG. 15. A cross sectional view of the bucket and a piston assembly is depicted while the rotor is in the initial state. In this embodiment, the chuck 110 remains at a constant position. The piston 130 moves the bucket 120 vertically upward relative to the chuck. The base 65 of the rotor is fixed to the chuck by vacuum or by mechanical means while the cover 50 is moved upward with the bucket; expanding the volume of the processing chamber by stretching the sidewalls 66 as shown in FIG. 16. When the pressure is relieved in the cylinder 129, the springs 127 move the bucket downward to the original position. Hence, the rotor retracts to the initial volume.

Figure 17:
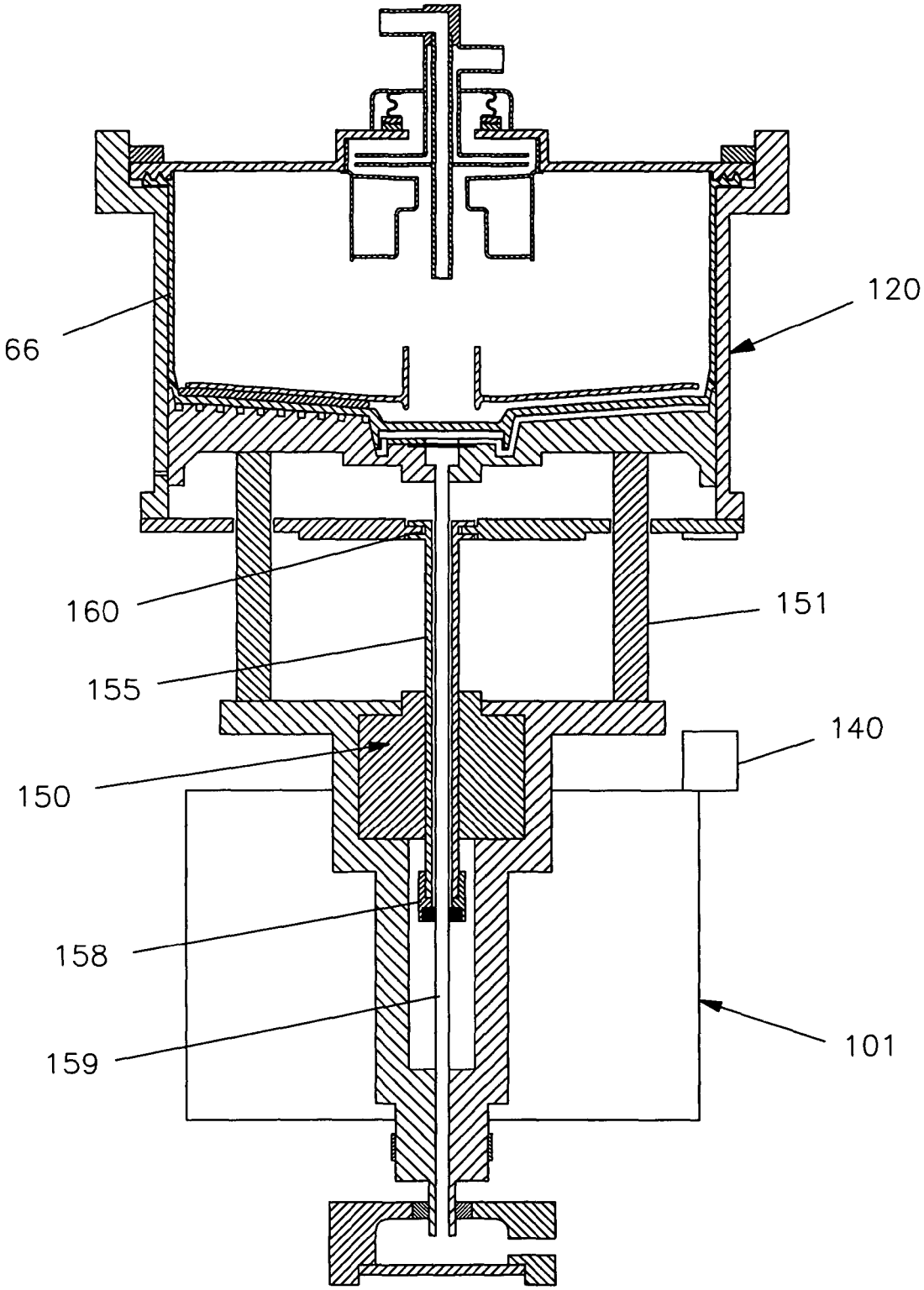

FIG. 17 illustrates a cross sectional view of a centrifuge assembly with an embedded motor in the rotating assembly. In this embodiment, the motor moves the bucket 120 vertically upward and downward relative to the chuck. As the cover moves away from the chuck, the volume of the chamber increases by stretching the rotor's sidewalls 66.

Having now described a few embodiments of the invention, it should be apparent to those skilled in the art that the foregoing is merely illustrative and not limiting, having been presented by way of example only. Numerous modifications and other embodiments are within the scope of ordinary skill in the art and are contemplated as falling within the scope of the invention as defined by the appended claims and equivalents thereto. The contents of all references, issued patents, and published patent applications cited throughout this application are hereby incorporated by reference. The appropriate components, processes, and methods of those patents, appli-cations and other documents may be selected for the present invention and embodiments thereof.

What is claimed is:

1. A centrifuge system comprising a rotor and having means for spinning the rotor and a plate that spins with the rotor, the rotor having an axis of rotation and being readily mountable to and dismountable from the centrifuge system, the rotor comprising:

a fixed portion including a conduit assembly, a chamber of varying volume rotatably mounted around the fixed portion and the axis of rotation, the chamber having a base, said base having a periphery circumscribed by a continuous impermeable stretchable side wall, wherein the wall is seamlessly joined to the periphery of said base, the chamber including a cover spaced axially apart from the base, the wall extending axially from the periphery of the base to and around a periphery of the cover to which the wall is joined, the wall being stretchable to form a chamber of variable volume between the cover and the base;

the rotor being mountable to the centrifuge system such that the base is captured by the plate for rotation together with the rotor inside the centrifuge system, said plate being controllably movable by the centrifuge system to move along the axis of rotation, the base of the rotor being fixedly held by said plate and movable along with the plate along the axis of rotation, the volume of the chamber increasing upon stretching of the side wall when the base is displaced axially from the cover, the volume of the chamber decreasing upon contraction of the side wall when the base is displaced axially closer to the cover, the side wall maintaining its joinder to the periphery of the base and the cover on stretching and contraction.

2. A centrifuge system according to claim 1, including a conduit assembly having first and second conduits, the first conduit providing unseparated fluid to the chamber while separated fluid components exit the chamber through the second conduit.

3. A centrifuge system according to claim 1, wherein the rotor further includes a core member fixedly mounted to the cover for rotation about the axis of rotation, said core including openings providing fluid communication channels between said chamber and a fluid exiting conduit.

4. A centrifuge system according to claim 3, wherein the core member comprises an inner core element forming an enclosed cylindrical annulus.

5. A centrifuge system according to claim 1, wherein the rotor further includes a second plate member fixedly mounted to the body at a fixed distance from the base for rotation about the axis of rotation, said plate member extending substantially to the periphery of the chamber and having a central opening.

6. A centrifuge system according to claim 5, wherein the second plate member further includes a splash barrier vertically extruded from the opening at the center of said diverter.

7. A centrifuge system according to claim 1, wherein the volume of the chamber increases by pulling the stretchable wall of the body and decreases by retracting the stretched wall.

8. A centrifuge system according to claim 1, wherein the volume of the chamber varies by controllably displacing the cover closer to or further from the base while the continuous stretchable side wall remains bonded to the periphery of the base on one side and the cover on an opposing side.

9. A centrifuge system according to claim 1, wherein the stretchable wall is welded to or extruded from the base of the body.

10. A centrifuge system comprising a rotor and having means for spinning the rotor and a plate that spins with the rotor, the rotor having an axis of rotation and being readily mountable to and dismountable from the centrifuge system, the rotor comprising:

a fixed portion including a conduit assembly, a chamber of varying volume rotatably mounted around the fixed portion and the axis of rotation, the chamber having a base, said base having a periphery circumscribed by a continuous impermeable stretchable side wall, wherein the wall is seamlessly joined to the periphery of said base, the chamber including a cover spaced axially apart from the base, the wall extending axially from the periphery of the base to and around a periphery of the cover to which the wall is joined, the wall being stretchable to form a chamber of variable volume between the cover and the base;

a core member fixedly mounted to the cover for rotation about the axis of rotation, said core including openings providing fluid communication between said chamber and a fluid exiting conduit, and a second plate member fixedly mounted to the body at a fixed distance from the base for rotation about the axis of rotation, said diverter member extending substantially to the periphery of the chamber and having a central opening, the rotor being mountable to the centrifuge system such that the base is captured by the plate for rotation together with the rotor inside the centrifuge system, said plate being controllably movable by the centrifuge system to move along the axis of rotation, the base of the rotor being fixedly held by said plate and movable along with the plate along the axis of rotation, the volume of the chamber increasing upon stretching of the side wall when the base is displaced axially from the cover, the volume of the chamber decreasing upon contraction of the side wall when the base is displaced axially closer to the cover, the side wall maintaining its joinder to the periphery of the base and the cover on stretching and contraction.

* * * * *